US007056096B2

(12) United States Patent
Takagi et al.

(10) Patent No.: US 7,056,096 B2
(45) Date of Patent: Jun. 6, 2006

(54) PUMP

(75) Inventors: Kunihiko Takagi, Okaya (JP); Takeshi Seto, Chotu (JP)

(73) Assignee: Seiko Epson Corporation, Tokyo (JP)

( * ) Notice: Subject to any disclaimer, the term of this patent is extended or adjusted under 35 U.S.C. 154(b) by 434 days.

(21) Appl. No.: 10/447,102

(22) Filed: May 29, 2003

(65) Prior Publication Data

US 2004/0018100 A1 Jan. 29, 2004

(30) Foreign Application Priority Data

Jun. 3, 2002 (JP) ..... 2002-161818
Nov. 11, 2002 (JP) ..... 2002-326913

(51) Int. Cl.
*F04B 17/03* (2006.01)
*F04B 49/00* (2006.01)

(52) U.S. Cl. ..... 417/44.2; 417/413.2; 417/557

(58) Field of Classification Search ..... 417/44.2, 417/413.1, 413.2, 557
See application file for complete search history.

(56) References Cited

U.S. PATENT DOCUMENTS

| | | | | |
|---|---|---|---|---|
| 6,074,178 | A * | 6/2000 | Bishop et al. | 417/413.2 |
| 6,104,127 | A | 8/2000 | Kameyama et al. | |
| 6,203,291 | B1 | 3/2001 | Stemme et al. | |
| 6,283,717 | B1 | 9/2001 | Yamada | |
| 6,604,909 | B1 * | 8/2003 | Schoenmeyr | 417/44.2 |
| 6,623,256 | B1 * | 9/2003 | Takagi et al. | 417/413.2 |
| 6,716,002 | B1 * | 4/2004 | Higashino | 417/413.2 |

FOREIGN PATENT DOCUMENTS

| | | |
|---|---|---|
| CH | 280618 | 1/1952 |
| DE | 25 19 962 | 11/1976 |
| DE | 44 22 743 A1 | 1/1996 |
| GB | 741015 | 11/1955 |
| JP | A 8-506874 | 7/1996 |
| JP | A 8-312537 | 11/1996 |
| JP | A 10-220357 | 8/1998 |

OTHER PUBLICATIONS

Anders Olsson et al.; "An Improved Valve-Less Pump Fabricated Using Deep Reactive Ion Etching"; IEEE; 1996; pp. 479-484.

* cited by examiner

*Primary Examiner*—Michael Koczo, Jr.
(74) *Attorney, Agent, or Firm*—Oliff & Berridge, PLC

(57) ABSTRACT

The invention provides a pump with high driving efficiency in which the number of mechanical switching valves is decreased to reduce pressure loss and increase reliability, and which is ready for high load pressure and high-frequency driving, and which increases the discharged fluid volume for one cycle of pumping. A circular diaphragm arranged on the bottom of a casing has the outer edge fixed to the casing. The diaphragm includes a piezoelectric element to move the diaphragm on the bottom surface thereof. The space between the diaphragm and the top wall of the casing serves as a pump chamber, wherein a suction channel and a discharge channel are opened to the pump chamber, the suction channel having a check valve serving as a fluid resistive element and the discharge channel being always communicated with the pump chamber, even during the operation of the pump. In the pump, the activation of the piezoelectric element is controlled by a cycle control device so as to provide the cycle of the diaphragm in which the volume and the pressure of the discharged fluid of the pump are increased.

18 Claims, 17 Drawing Sheets

DISPLACEMENT TIME $t_4$

DISPLACEMENT TIME $t_3$

DISPLACEMENT TIME $t_2$

| DISPLACEMENT TIME | DISPLACEMENT | LOAD PRESSURE | CYCLE |
|---|---|---|---|
| $t_1$ | $X_1$ | $P_1$ | $T_1$ |
| | | $P_2$ | $T_2$ |
| | | : | : |
| | | $P_n$ | $T_n$ |
| | $X_2$ | $P_1$ | $T_{n+1}$ |
| | | $P_2$ | $T_{n+2}$ |
| | | : | : |
| | | $P_n$ | $T_{2n}$ |
| | : | : | : |

FIG. 7

PUMP

BACKGROUND OF THE INVENTION

1. Field of Invention

The present invention relates to a positive displacement pump in which the capacity in a pump chamber is changed with a piston, a diaphragm or other device to move fluid. More specifically, the invention relates to a reliable pump with high flow rate.

2. Description of Related Art

Such related art pumps have an arrangement in which check valves are disposed between a suction channel and a discharge channel. A pump chamber is provided that has a capacity that can be varied. Such a pump is disclosed in Japanese Unexamined Patent Application Publication No. 10-220357 (JP 357).

The related art also includes an arrangement of a pump to produce one-directional flow using viscous resistance of fluid, which has a valve in the discharge channel. When the valve is opened, the suction channel has higher fluid resistance than the discharge channel. Such a pump is disclosed in Japanese Unexamined Patent Application Publication No. 08-312537 (JP 537).

In order to enhance the reliability of a pump, the related art provides a pump with an arrangement in which a mounting part is not provided and in which both the suction channel and the discharge channel have a compression component having a channel shape in which pressure drop varies depending on the direction of the flow. Such a pump is disclosed in PCT Japanese Translation Patent Publication No. 08-506874 (JP 874), and Anders Olsson, An improved valve-less pump fabricate using deep reactive ion etching, 1996 IEEE 9th International Workshop on Micro Electro Mechanical Systems, pgs. 479–484 (Olsson).

SUMMARY OF THE INVENTION

The arrangement of JP 357, however, poses a problem that both the suction channel and the discharge channel require a check valve, causing a loss of pressure when fluid passes through the two check valves. Also, the check valves are repeatedly opened and closed, causing possible fatigue damages. There is also a problem of deteriorating reliability with an increase in the number of the check valves.

In the arrangement of JP 537, the fluid resistance of the suction channel must be high in order to decrease backflow generated in the suction channel during a pump discharge process. Thus, the pump suction process becomes fairly longer than the discharge process in order to introduce the fluid into the pump chamber against the fluid resistance. Accordingly, the frequency in the discharge/suction cycle of the pump becomes fairly low.

In the pump in which a piston or a diaphragm is vertically moved, the higher the frequency for vertical movement, the higher the flow rate and output become, with the piston or the diaphragm having the same area. With the arrangement of JP 537, however, activation is allowed only with low frequency, as described above, thus posing a problem in that a compact high-output pump cannot be provided.

With the arrangement of JP 874, the net quantity of fluid that passes though the compression component in response to the variations in the volume of the pump chamber is let flow in one direction owing to the difference in pressure drop depending on the direction of the flow. Accordingly, backflow is increased with an increase in the external pressure (load pressure) at the pump outlet, thus posing a problem that the pump does not operate at high load pressure. According to Olsson, the maximum load pressure is about 0.760 atmospheric pressure.

Accordingly, the present invention provides a pump with high driving efficiency in which the number of mechanical switching valves is decreased to reduce pressure loss and reliability is enhanced, and which is ready for high load pressure and high-frequency driving, and which increases the discharged fluid volume of the pump.

In order to address or solve the above and/or other problems, the present invention provides, a pump including: an actuator to change the position of a moving wall, such as a piston and a diaphragm; a driving device to control the driving of the actuator; a pump chamber the capacity of which can be varied by the displacement of the moving wall; a suction channel for the admission of working fluid into the pump chamber; and a discharge channel for the delivery of the working fluid from the pump chamber. The discharge channel is opened to the pump chamber during the operation of the pump. The combined inertance of the suction channel is lower than the combined inertance of the discharge channel. The suction channel includes a fluid resistive element of which fluid resistance during the inflow of the working fluid into the pump chamber becomes lower than the fluid resistance during the outflow. The driving device includes a cycle control device to change the motion cycle of the moving wall.

In this case, the inertance L is provided by the expression $L=\rho\times l/S$, where S is the cross-sectional area of the channel, l is the length of the channel, and ρ is the density of the working fluid. The relation $\Delta P=L\times dQ/dt$ is derived by transforming the equation of motion of the in-channel fluid using the inertance L, where ΔP is the differential pressure of the channel and Q is the flow rate of the channel. More specifically, the inertance L indicates the degree of influence exerted on the change of the flow rate by unit pressure. The larger the inertance L, the smaller the change of the flow rate is, and the smaller the inertance L, the larger the change of the flow rate is.

It is sufficient to obtain combined inertance for the parallel connection of a plurality of channels or the serial connection of a plurality of channels with different shapes by combining the respective inertance values of the channels in a manner similar to the parallel connection and serial connection of the inductance in the electrical circuit.

In this case, the suction channel denotes a channel to the fluid inflow end face of the inlet connecting pipe. When a pulse absorbing device is connected in the middle of the pipe, however, it denotes a channel from the pump chamber to the connection with the pulse absorbing device. Furthermore, when the suction channels of a plurality of pumps are joined, it denotes a channel from the pump chamber to the joint. The same is true for the discharge channel.

Since the combined inertance of the suction channel is smaller than that of the discharge channel, the fluid of the suction channel flows in at high flow-rate change to increase the suction fluid volume (=discharge fluid volume).

Providing the cycle control device prevents or reduces useless consumption of the removed fluid volume to increase the volume and pressure of the discharged fluid of the pump, thus providing a pump with high driving efficiency.

Preferably, the cycle control device changes the motion cycle of the moving wall depending on the load pressure downstream from the discharge channel.

Preferably, the cycle control device changes the motion cycle of the moving wall depending on the displacement time, the displacement amount, or the displacement rate in the pump-chamber-capacity compression process of the moving wall.

Preferably, the cycle control device changes the motion cycle of the moving wall in accordance with the sense information of a pump-pressure sensing device to sense the pressure in the pump.

Preferably, the cycle control device controls to start the next motion of the moving wall when the pump-pressure sensing device senses an increase in pressure after the completion of the previous motion of the moving wall.

Preferably, the cycle control device changes the motion cycle of the moving wall in accordance with a calculation value using a predetermined value and the sensed value of the pump-pressure sensing device.

Preferably, the predetermined value is the pressure in the pump chamber which is measured by the pump-pressure sensing means before the driving of the actuator.

Preferably, the predetermined value is the pressure in the pump chamber which is measured by the pump-pressure sensing device after a lapse of a predetermined time from the previous application of the drive waveform.

Preferably, the predetermined value is a value inputted in advance and substantially corresponding to the load pressure downstream from the discharge channel.

Preferably, there is provided a load-pressure sensing device to sense the load pressure downstream from the discharge channel. The predetermined value is a value measured by the load-pressure sensing device.

Preferably, the calculation value is obtained by time-integrating the difference between the sensed value and the predetermined value for the period during which the value sensed by the pump-pressure sensing device is larger than the predetermined value.

Preferably, there is provided a passive valve in the suction channel. The cycle control device senses the displacement of the valve and changes the motion cycle of the moving wall on the basis of the sensed value.

Preferably, the cycle control device changes the motion cycle of the moving wall in accordance with the sense information of a flow velocity measuring device to sense the flow velocity of the downstream including the discharge channel.

Preferably, the cycle control device controls to start the next motion of the moving wall after the flow velocity measuring device has sensed an increase in flow velocity from the completion of the previous motion of the moving wall.

Preferably, the cycle control device changes the motion cycle of the moving wall depending on the difference between the maximum value and the minimum value of the flow velocity measured by the flow velocity measuring device.

Preferably, the cycle control device changes the motion cycle of the moving wall in accordance with the sense information of a moving-fluid-volume measuring device to sense the suction volume of the suction channel or the discharged volume of the discharge channel.

Preferably, the actuator is a piezoelectric element.

Preferably, the actuator is a giant magnetostrictive element.

A pump is also provided that includes: an actuator to change the position of a moving wall such as a piston and a diaphragm; a driving device to control activation of the actuator; a pump chamber the capacity of which can be varied by the displacement of the moving wall; a suction channel for the admission of working fluid into the pump chamber; and a discharge channel for the delivery of the working fluid from the pump chamber.

The suction channel includes a fluid resistive element of which fluid resistance during the inflow of the working fluid into the pump chamber becomes lower than the fluid resistance during the outflow. The driving device drives the actuator a plurality of times during one cycle of pressure variation in the pump.

According to the invention, discharged fluid volume can be increased and the durability of the check valve can be enhanced.

A pump is also provided that includes: an actuator to change the position of a moving wall, such as a piston and a diaphragm; a driving device to control activation of the actuator; a pump chamber the capacity of which can be varied by the displacement of the moving wall; a suction channel for the admission of working fluid into the pump chamber; and a discharge channel for the delivery of the working fluid from the pump chamber.

The suction channel includes a fluid resistive element of which fluid resistance during the inflow of the working fluid into the pump chamber becomes lower than the fluid resistance during the outflow. The frequency with which the capacity variation in the pump chamber becomes maximum and the in-pump fluid resonance frequency are substantially equal.

The actuator itself can be driven with less displacement without decreasing the volume of fluid discharged from the pump, so that the inner loss of the actuator is decreased, thus offering an advantage of driving the pump with high efficiency.

It is preferable that the combined inertance of the suction channel be lower than the combined inertance of the discharge channel to increase the suction flow rate and increasing the discharged fluid volume.

Preferably, the discharge channel is opened to the pump chamber during the operation of the pump.

Preferably, the actuator is a piezoelectric element.

Preferably, the actuator is a giant magnetostrictive element.

BRIEF DESCRIPTION OF THE DRAWINGS

FIG. 7 is a schematic showing maps stored by the cycle control device according to the first exemplary embodiment;

DETAILED DESCRIPTION OF PREFERRED EMBODIMENTS

Exemplary embodiments of the present invention are described with reference to the drawings below.

Figure 1:
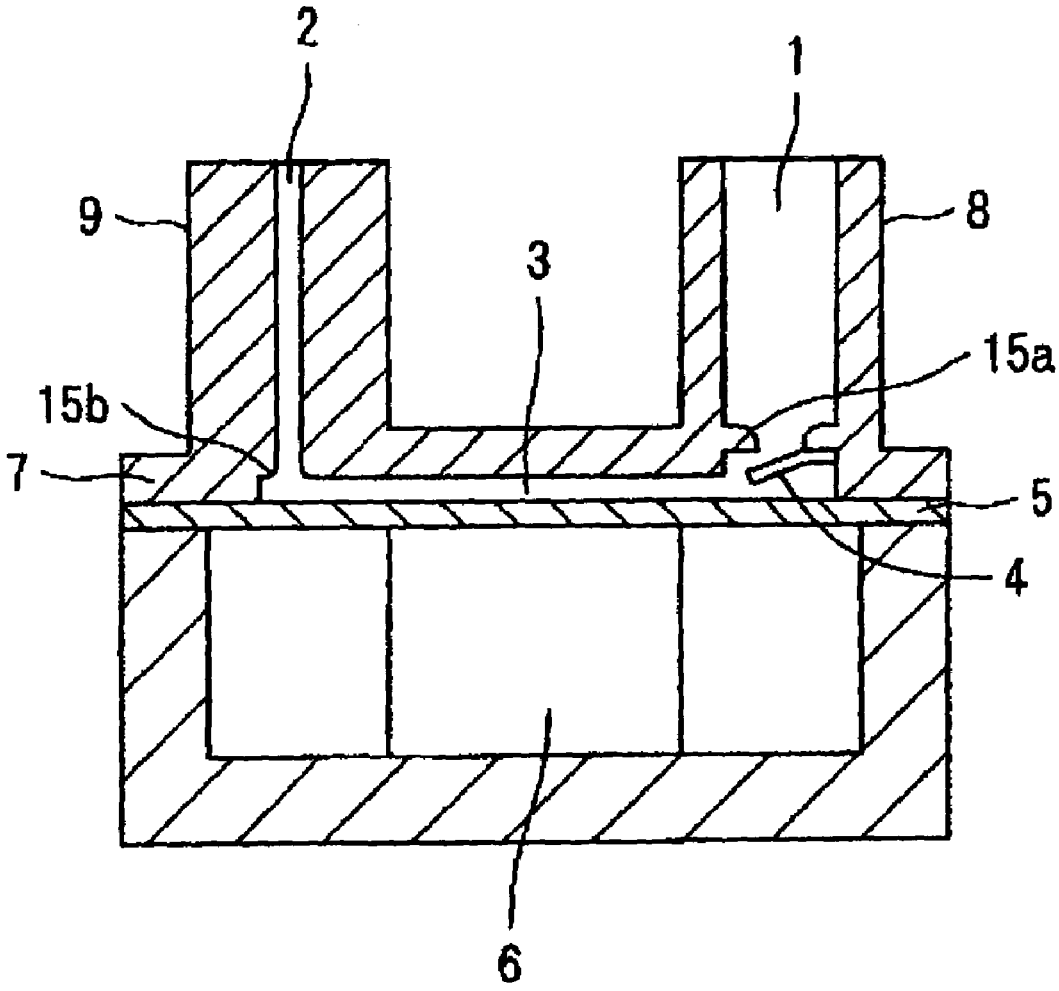
FIG. 1 is a longitudinal sectional view of a pump according to a first exemplary embodiment of the present invention.

Referring to FIG. 1, the arrangement of a pump according to the exemplary embodiments of the present invention are described below. FIG. 1 is a longitudinal sectional view of the pump of the present invention, in which a circular diaphragm 5 is arranged on the bottom of a cylindrical casing 7. The outer edge of diaphragm 5 is fixed to the casing 7 such that it can be elastically deformed. A piezoelectric element 6 extending vertically in the drawing is arranged on the bottom of the diaphragm 5, as an actuator to move the diaphragm 5.

A narrow space between the diaphragm 5 and the top wall of the casing 7 serves as a pump chamber 3. A suction channel 1 and a discharge channel 2 are opened to the pump chamber 3, the suction channel 1 having a check valve 4 serving as a fluid resistive element and the discharge channel 2 being a tubular channel including a narrow hole which is always opened to the pump chamber even during the operation of the pump. Part of the periphery of a component that constitutes the suction channel 1 serves as an inlet connecting pipe 8 to connect an external element (not shown) with the pump. Part of the periphery of a component that constitutes the discharge channel 2 serves as an outlet connecting tube 9 to connect an external element (not shown) with the pump. Both the suction channel and the discharge channel have chamfered portions 15*a* and 15*b*, which are chamfered on the working-fluid inlet side, respectively.

Inertance L is now defined. The inertance L can be obtained by equation $L=\rho\times l/S$, where S is the cross-sectional area of the channel, l is the length of the channel, and ρ is the density of the working fluid. The relation $\Delta P=L\times dQ/dt$ can be derived by transforming the equation of motion of the in-channel fluid using the inertance L, where ΔP is the differential pressure of the channel, and Q is the flow rate in the channel.

More specifically, the inertance L designates the degree of influence of the unit pressure on changes in flow rate. The larger the inertance L, the smaller the change in flow rate. The smaller the inertance L, the larger the flow rate change.

Combined inertance for the parallel connection of a plurality of channels and the serial connection of a plurality of channels having different shapes may be obtained by combining the respective inertance values of the channels in a manner similar to the parallel connection and the serial connection of inductance in an electrical circuit.

The suction channel in this case denotes a channel to the end face of the fluid inlet of the inlet connecting pipe 8. When the channel has a pulse absorbing device connected in the middle thereof, however, it denotes a channel from the inside of the pump chamber 3 to the connection with the pulse absorbing means. Furthermore, when the plurality of suction channels 1 of a pump are joined, it denotes a channel from the inside of the pump chamber 3 to the joint section. The same is true for the discharge channel.

Referring to FIG. 1, the reference symbols of the lengths and the areas of the suction channel 1 and the discharge channel 2 are described below. In the suction channel 1, the length of the reduced-diameter pipe near the check valve 4 is L1 and its area is S1, and the length of the remaining enlarged-diameter pipe is L2 and its area is S2. In the discharge channel 2, the length of the path of the discharge channel 2 is L3 and its area is S3.

The inertance relationship between the suction channel 1 and the discharge channel 2 is described below using the aforesaid symbols and the density ρ of the working fluid.

The inertance of the suction channel 1 is calculated by $\rho\times L1/S1+\rho\times L2/S2$. On the other hand, the inertance of the discharge channel 2 is calculated as $\rho\times L3/S3$. The channels have dimensional relationship that satisfies $\rho\times L1/S1+\rho\times L2/S2<\rho\times L3/S3$.

In the above-described arrangement, the shape of the diaphragm 5 is not limited to a circle. Also, for example, even if the discharge channel 2 has a valve element to protect pump components from excessive load pressure which may be applied when the pump is possibly stopped, there is no problem as long as it is opened to the pump chamber during at least the operation of the pump. The check valve 4 may be not only of a type of opening and closing with the differential pressure of the fluid, but of a type of controlling the opening and the closing by a force other than the differential pressure of the fluid.

The actuator 6 to move the diaphragm 5 may be made of any extendable material. With the pump structure of the present invention, however, the actuator and the diaphragm 5 are connected without using a displacement increasing mechanism, and so the diaphragm can be driven at high frequencies. Accordingly, the use of the piezoelectric element 6 with high response frequency as in this exemplary embodiment increases flow rate by high frequency driving, thus providing a compact high-output pump. Similarly, giant magnetostrictive elements with high frequency response may be used.

Since the mechanical switching valve may be arranged only at the suction channel, a decrease in flow rate due to a valve is reduced and also high reliability is provided.

In the exemplary embodiments, water is used as working fluid to be introduced into the pump. However, other liquids including alcohol-based liquids, oil-based liquids, and liquids with additives, may be used.

The motion cycle of the diaphragm with the arrangement shown in FIG. 1 is described below with reference to FIGS. 2–5.

Figure 2:
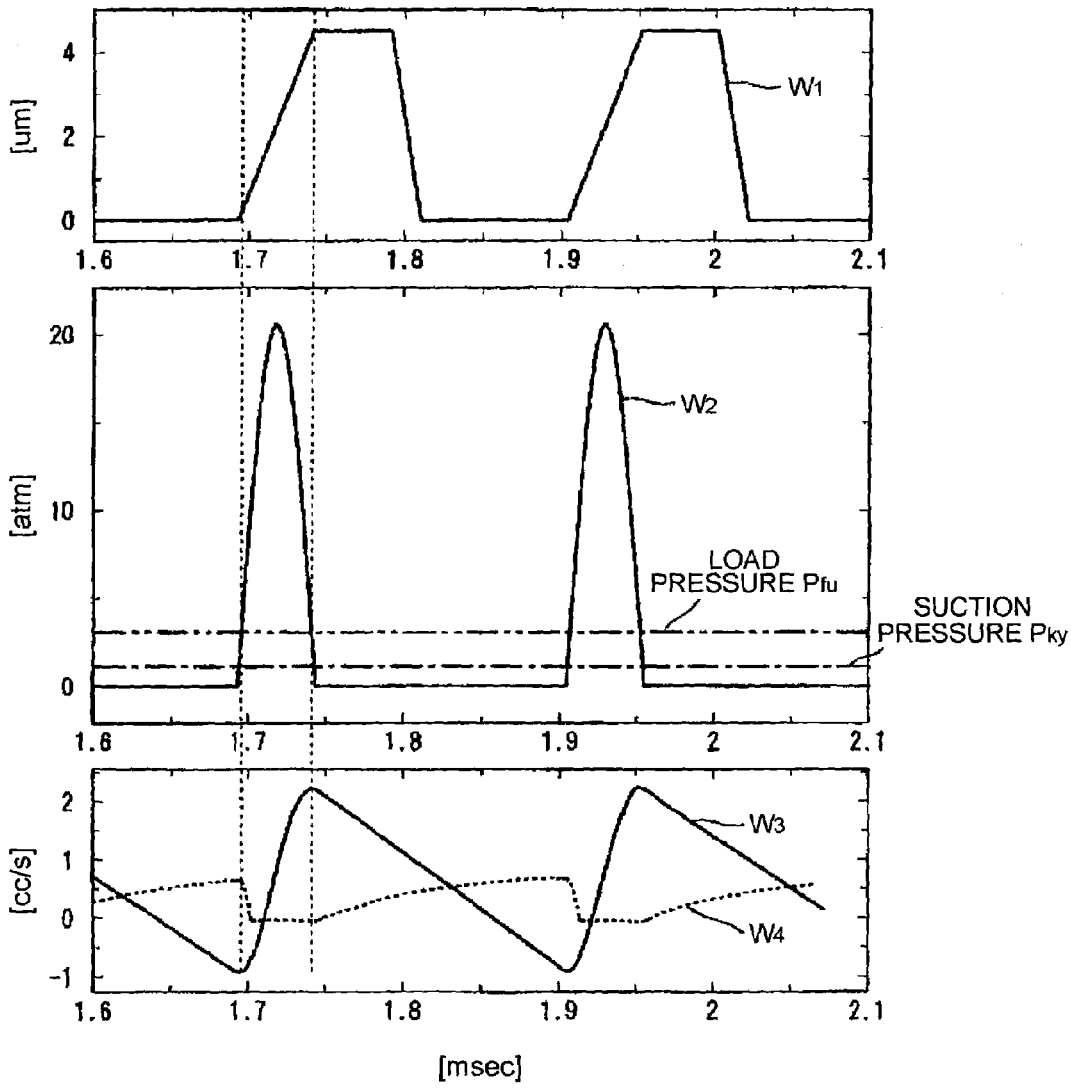
FIG. 2 is a graph showing the operation of the pump according to the first exemplary embodiment.

FIG. 2 shows a waveform W1 of the displacement of the diaphragm 5, a waveform W2 of the inner pressure of the pump chamber 3, a waveform W3 of the volume velocity of a fluid that passes through the discharge channel 2 (the cross-sectional area of the discharge channel×the flow velocity of the fluid, which is equal to the flow rate in this case), and the waveform of a volume velocity W4 of a liquid that passes through the check valve 4, during the operation of the pump. A load pressure $P_{fu}$ shown in FIG. 2 is a fluid pressure downstream from the discharge channel 2. A suction pressure $P_{ky}$ is a fluid pressure upstream from the suction channel 1.

The positive slope of the waveform shows the process of decreasing the capacity of the pump chamber 3 by the extension of the piezoelectric element 6, as the waveform W1 of the displacement of the diaphragm 5 shows. The negative slope of the waveform shows the process of increasing the capacity of the pump chamber 3 by the contraction of the piezoelectric element 6.

The flat waveform with a displacement of about 4.5 μm shows the maximum displacement of the diaphragm 5, that is, the displacement position of the diaphragm 5 where the capacity of the pump chamber 3 becomes minimum.

When the process of decreasing the capacity of the pump chamber 3 starts, the inner pressure of the pump chamber 3 starts to increase, as shown by the waveform W2 of the inner pressure variations in the pump chamber 3. Before the process of decreasing the capacity of the pump chamber 3 terminates, the inner pressure of the pump chamber 3 starts to decrease after it has reached the maximum inner pressure of the pump chamber 3. The point of the maximum inner pressure is a point where the volume velocity of the removed fluid by the diaphragm 5 becomes equal to the volume velocity of the fluid in the discharge channel 2 shown by the waveform W3.

The reason is that since there is a relation before the time, as follows:

the volume velocity of the removed fluid−the volume velocity of the fluid that passes through the discharge channel 2>0, the fluid in the pump chamber 3 is compressed correspondingly to increase the pressure therein, and that since there is a relation after the time, as follows:

the volume velocity of the removed fluid−the volume velocity of the fluid that passes through the discharge channel 2<0, the compression amount of the fluid in the pump chamber 3 is reduced correspondingly to decrease the pressure therein.

The pressure in the pump chamber 3 varies in accordance with the relationship between the volume change ΔV and the compression ratio of the fluid, $\Delta V$=the volume of fluid removed by the diaphragm+the volume of suction fluid−the volume of discharged fluid, where ΔV is the volume change in the pump chamber 3 with every moment. Accordingly, even when the capacity of the pump chamber 3 is decreasing, the pressure in the pump chamber 3 can become lower than the load pressure $P_{fu}$.

In the case of FIG. 2, when the pressure in the pump chamber 3 becomes lower than the suction pressure $P_{ky}$ to be close to absolute zero atmospheric pressure, aeration or cavitation occurs in which components that have dissolved in the working fluid are gasified to bubbles. And the pressure in the pump chamber 3 is saturated at about absolute zero atmospheric pressure. However, when the overall channel system including the pump is pressurized and the suction pressure $P_{ky}$ is sufficiently high, the aeration and cavitation may not occur.

In the discharge channel 2, the period during which the pressure in the pump chamber 3 is higher than the load pressure $P_{fu}$ is substantially the period during which the volume velocity of the fluid increases, as shown by the waveform W3 of the fluid volume velocity in the discharge channel 2. When the pressure in the pump chamber 3 becomes lower than the load pressure $P_{fu}$, the volume velocity of the fluid in the discharge channel 2 starts to decrease.

There is the following relationship in the fluid in the discharge channel 2.

[Expression 1] (1)

$$\Delta P_{out} = R_{out}Q_{out} + L_{out}\frac{dQ_{out}}{dt}$$

where $\Delta P_{out}$ is the differential pressure between the pressure in the pump chamber 3 and the load pressure $P_{fu}$, $R_{out}$ is the fluid resistance in the discharge channel 2, $L_{out}$ is the inertance, and $Q_{out}$ is the volume velocity of the fluid.

Therefore, the change rate in the fluid volume velocity equals to a value obtained by dividing the difference between $\Delta P_{out}$ and $R_{out}\times Q_{out}$ by the inertance $L_{out}$. A value obtained by integrating the fluid volume velocity shown by the waveform W3 of one cycle is the discharged fluid volume for one cycle.

In the suction channel 1, when the pressure in the pump chamber 3 becomes lower than the suction pressure $P_{ky}$, the check valve 4 is opened by the differential pressure. And the fluid volume velocity increases, as shown by the waveform W4 designating the change in the volume velocity of the fluid that passes through the check valve 4. When the pressure in the pump chamber 3 becomes higher than the suction pressure $P_{ky}$, the fluid volume velocity begins to decrease. The check effect of the check valve 4 reduces or prevents backward flow.

There is the following relationship in the fluid in the discharge channel 1.

[Expression 2] (2)

$$\Delta P_{in} = R_{in}Q_{in} + L_{in}\frac{dQ_{in}}{dt}$$

where $\Delta P_{in}$ is the differential pressure between the pressure in the pump chamber 3 and the suction pressure $P_{ky}$, $R_{in}$ is the fluid resistance in the discharge channel 2, $L_{in}$ is the inertance, and $Q_{in}$ is the volume velocity of the fluid.

Therefore, the change rate in the fluid volume velocity equals to a value obtained by dividing the difference between $\Delta P_{in}$ and $R_{in}\times Q_{in}$ by the inertance $L_{in}$ of the suction channel 1.

A value obtained by integrating the fluid volume velocity shown by the waveform W4 of one cycle is the suction fluid volume for one cycle. The suction fluid volume is equal to the discharged fluid volume calculated by the waveform W3.

The time integration of the definition of the inertance is expressed as follows:

[Expression 3] (3)

-continued $$\int \Delta p dt = LQ|_{t0}^{t1}$$

Since the inertance is constant, the larger the integral of the differential pressure of both ends of a channel, the larger the change in the volume velocity Q of the in-channel fluid during the period. For the discharge channel 2, the larger the integral of the differential pressure between the inner pressure of the pump chamber 3 and the load pressure $P_{fit}$, the faster flow (also having a great momentum) toward the outlet generates in the fluid in the discharge channel 2 to increase the discharged fluid volume. A lot of fluid can be introduced from the suction channel 1 into the pump chamber 3 by the time when the momentum decreases, and accordingly, the time until the discharged fluid volume and the suction fluid volume become equal to each other is increased. In other words, in the discharge channel 2, the discharged flow rate (=suction flow rate) of the pump for one cycle and the time until the discharged fluid volume and the suction fluid volume become equal to each other vary depending on the value on the left side of the expression (3). When the displacement rate in the process of decreasing the capacity of the pump chamber by the diaphragm is increased, the value on the left side of the expression (3) tends to increase.

The timing to apply the next driving voltage to the piezoelectric element 6 after the previous application of the driving voltage is described below.

As described above, the pressure in the pump chamber 3 is varied depending on the relationship between the volume change ΔV and the compression ratio of the fluid, where ΔV is the volume change of the fluid in the pump chamber 3 with every moment, and $\Delta V$=fluid volume removed by the diaphragm 5+suction fluid volume−discharged fluid volume.

In the pump with this arrangement, the discharge channel 2 and the pump chamber 3 are opened to each other, so that when ΔV=0 is satisfied, the pressure in the pump chamber 3 becomes equal to the load pressure $P_{fit}$. Accordingly, in the range of ΔV<0, the pressure in the pump chamber 3 is lower than the load pressure $P_{fit}$. Therefore, when the next driving voltage is applied to the piezoelectric element 6 in the range of ΔV<0, the removed volume until ΔV=0 is satisfied is used to compress the fluid in the pump chamber 3 in order to make the pressure in the pump chamber 3 equal to the load pressure $P_{fit}$, which is useless.

Preventing the useless consumption of the removed volume allows an increase in the discharged fluid volume of the pump. To that end, it is recommended to apply the next driving voltage to the piezoelectric element 6 later than the time the discharged fluid volume and the suction fluid volume become equal to each other after the driving for one pumping has been terminated (after the net fluid volume removed by the diaphragm 5 has become zero).

Figure 3:
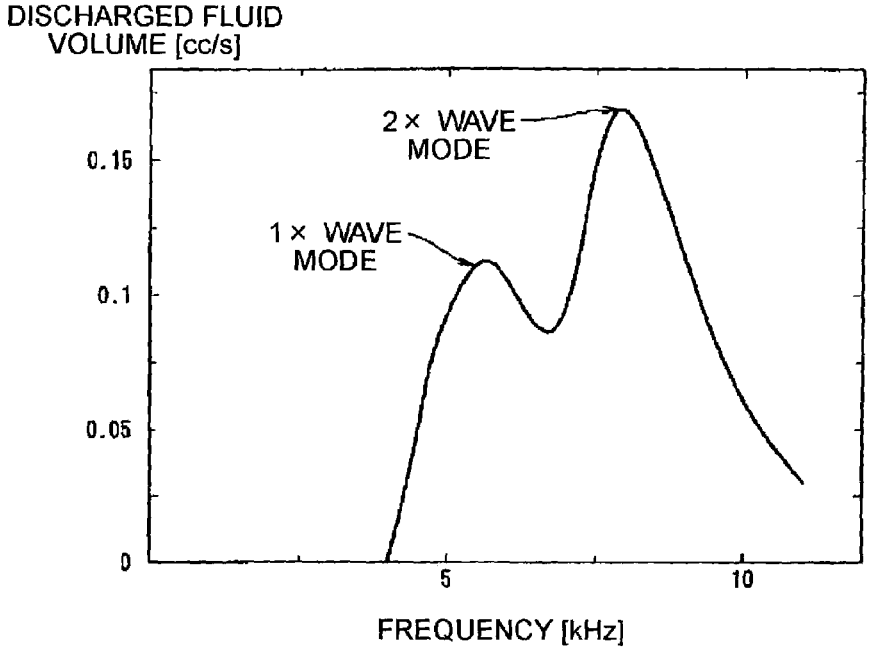
FIG. 3 is a graph showing the variation of discharged fluid volume with frequency changes.
Figure 4:
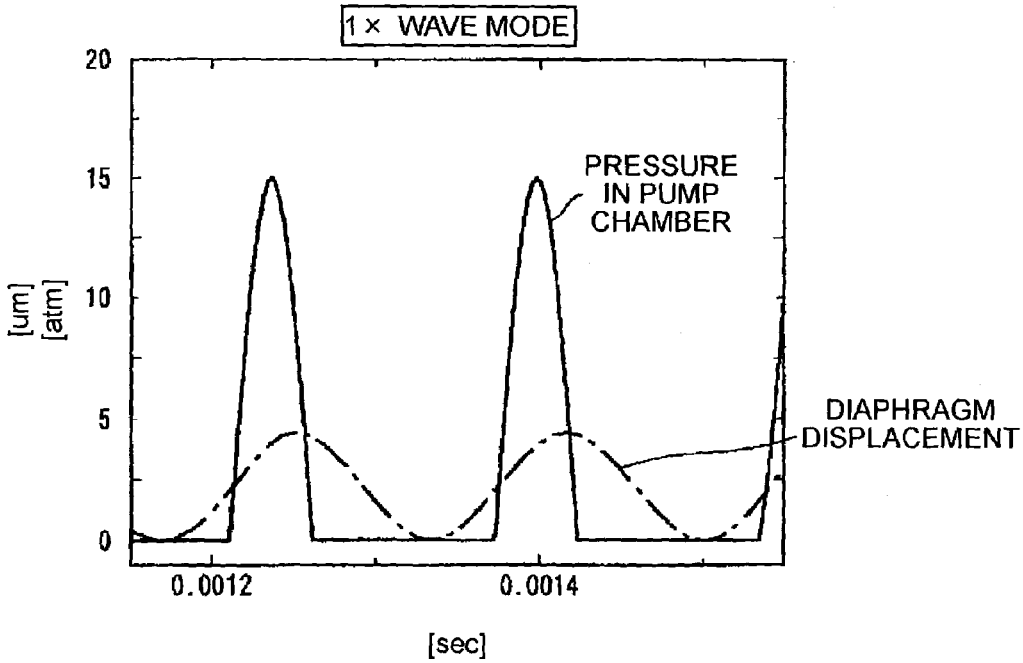
FIG. 4 is a graph showing a wave mode with a prescribed frequency.
Figure 5:
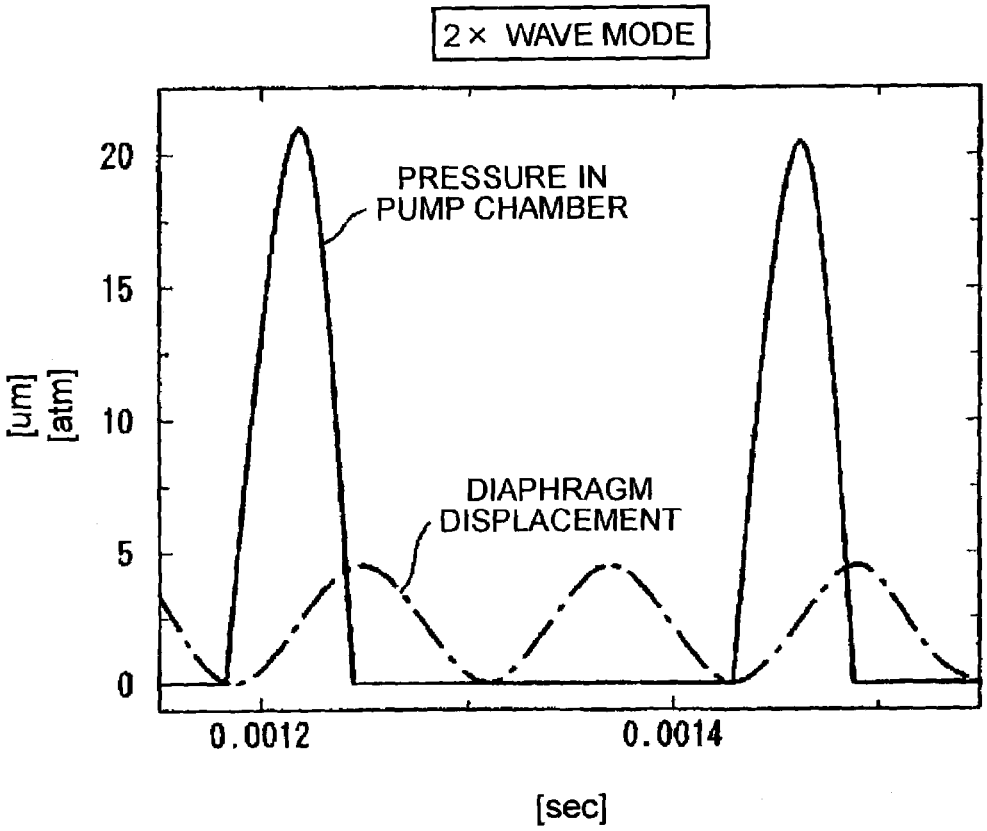
FIG. 5 is a graph showing a wave mode with a different frequency from that of FIG. 4.

The pressure wave of the fluid in the pump chamber 3, however, varies owing to various causes. When the diaphragm 5 is moved with a SIN wave, the discharged fluid volume varies for the driving cycle, as shown in FIG. 3. FIG. 3 shows two peaks of the discharged fluid volume. The pressure in the pump chamber 3 and the diaphragm displacement in the respective driving cycles corresponding to the peaks are shown in FIGS. 4 and 5. FIG. 4 shows a driving state called a 1× wave mode in which the cycle of diaphragm displacement and the cycle of the pressure in the pump chamber are equal to each other. FIG. 5 shows a driving state called a 2× wave mode in which the cycle of the pressure in the pump chamber is twice as long as the cycle of diaphragm displacement. The pressure waveforms in the pump chamber in FIGS. 4 and 5 differ from each other, and the respective values on the left side of the expression (3) also differ. More specifically, the peak of the pressure waveform in the 2× wave mode of FIG. 5 is higher than that of the 1× wave mode of FIG. 4, and the value on the left side of the expression (3) is also larger. Accordingly, the time when the discharged fluid volume and the suction fluid volume become equal also changes. (In FIG. 5 showing the 2× wave mode, the time until the discharged fluid volume and the suction fluid volume become equal is longer than that in FIG. 4 showing the 1× wave mode.) The peak of the discharged fluid volume shown in FIG. 3 is at a driving frequency at which the time when the discharge fluid volume and the suction fluid volume became equal is well synchronized with the period during which the diaphragm is moved in the direction to compress the capacity of the pump chamber. The reason why the pressure waveforms in the pump chamber differ between the two modes is because the displacements of the diaphragm are equal, but in comparison with FIG. 4, the driving cycle in FIG. 5 is shorter, so that the displacement rate in the process of decreasing the capacity of the pump chamber by the diaphragm is higher in FIG. 5.

As described above, the pressure in the pump chamber 3 is significantly influenced particularly by the time when the diaphragm 5 is displaced to decrease the capacity of the pump chamber 3 by the actuation of the piezoelectric element 6, the maximum displacement, the displacement rate, and the change in load pressure; accordingly, the time when the discharged fluid volume and the suction fluid volume become equal also varies, and furthermore, the optimum timing to apply the next driving voltage to the piezoelectric element 6 after the previous application of the driving voltage varies.

A description is provided below referring to FIG. 3.

In FIG. 3, the discharged fluid volume is increased by the generation of 2× wave rather than in 1× wave. Also, the number of switching operations of the check valve becomes one half of the driving frequency by the driving in 2× wave mode. As shown in FIG. 3, the number of switching operations of the check valve driven in 2× wave mode is smaller than that in 1× wave mode. Generally, fatigue fracture is related to the repeat number of loadings. Therefore, the durability of the check valve is further increased by driving in 2× wave mode. FIG. 3 shows a case in which the driving waveform of the diaphragm is SIN waveform. However, the same is true for the case of driving with a waveform close to the SIN waveform or a driving waveform in which the displacement rate of the diaphragm serves as the function of the driving cycle.

As described above, the peak frequency of the discharged fluid volume in FIG. 3 is a driving frequency at which the time when the discharge fluid volume and the suction fluid volume became equal (the time when the inner pressure of the pump chamber became equal to the load pressure) is well synchronized every time with the period during which the diaphragm is moved in the direction to compress the capacity of the pump chamber. Here, the frequency is referred to as an in-pump fluid resonance frequency.

The resonance frequency of the mechanical components that constitute the pump chamber, such as an actuator, a diaphragm, other wall components of the pump chamber, (the capacity change of the pump chamber 3 becomes maximum at the frequency) is substantially equalized to the in-pump fluid resonance frequency, so that the actuator itself can be driven with less displacement without decreasing the volume of fluid discharged from the pump, which offers an advantage of decreasing the inner loss of the actuator to drive the pump with high efficiency.

Figure 6:
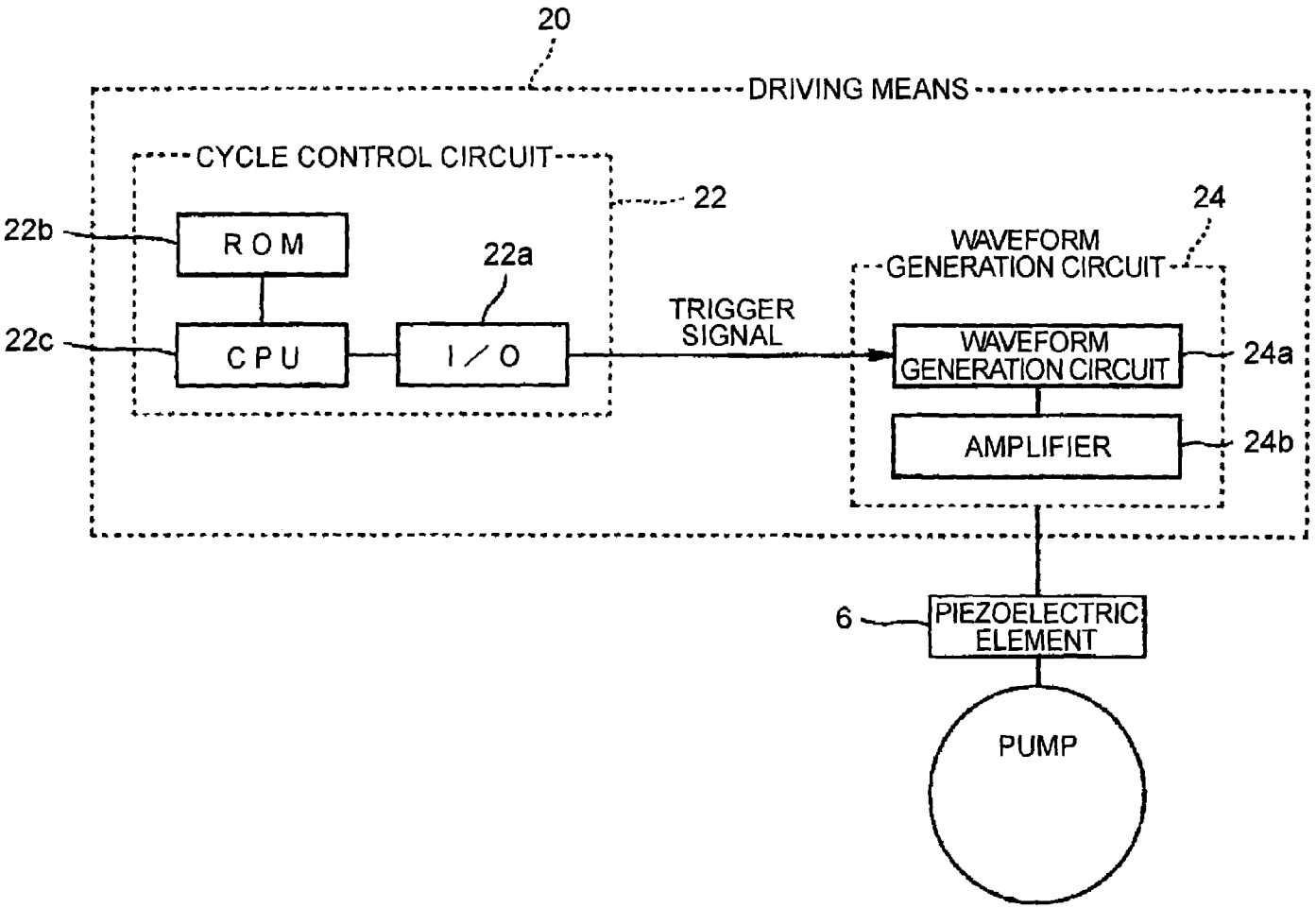
FIG. 6 is a schematic of a cycle control device according to the first exemplary embodiment of the present invention.

FIGS. 6 and 7 show a first exemplary embodiment according to the present invention.

FIG. 6 is a schematic of a driving device 20 to control the driving of the piezoelectric element 6 of this exemplary embodiment, composed of a cycle control circuit (a cycle control device) 22 and a voltage-waveform generation circuit 24.

The voltage-waveform generation circuit 24 includes a waveform generation circuit 24*a* to generate a voltage waveform once each time it receives a trigger signal, which is discussed below, the voltage waveform having been set before the reception of the trigger signal, and an amplifier circuit 24*b* to amplify voltage to power required to drive and supply it to the piezoelectric element 6.

The cycle control circuit 22 includes an I/O port 22*a* into which signals for the time (displacement time) to displace the diaphragm 5 in the direction to decrease the capacity of the pump chamber 3, the maximum displacement, and the load pressure are inputted, an ROM 22*b* which experimentally obtains the optimum motion cycle in advance for the combination of the respective input values and records maps shown in FIG. 7, and a CPU 22*c* to generate a trigger signal with a corresponding cycle with reference to the ROM 22*b* with the input values to the I/O port 22*a*.

According to this exemplary embodiment, the cycle control circuit 22 selects the optimum cycle for the displacement time, the maximum displacement, and the change in load pressure to control the piezoelectric element 6, and thus the diaphragm 5 is displaced in a state in which the discharged fluid volume and the suction fluid volume are equal or the suction fluid volume is large, thereby reducing or preventing useless consumption of the removed fluid volume and increasing the discharged fluid volume of the pump.

According to this exemplary embodiment, since there is no need to provide a sensor in the pump chamber 3, it is preferable when the pump chamber 3 is a narrow space.

Figure 8:
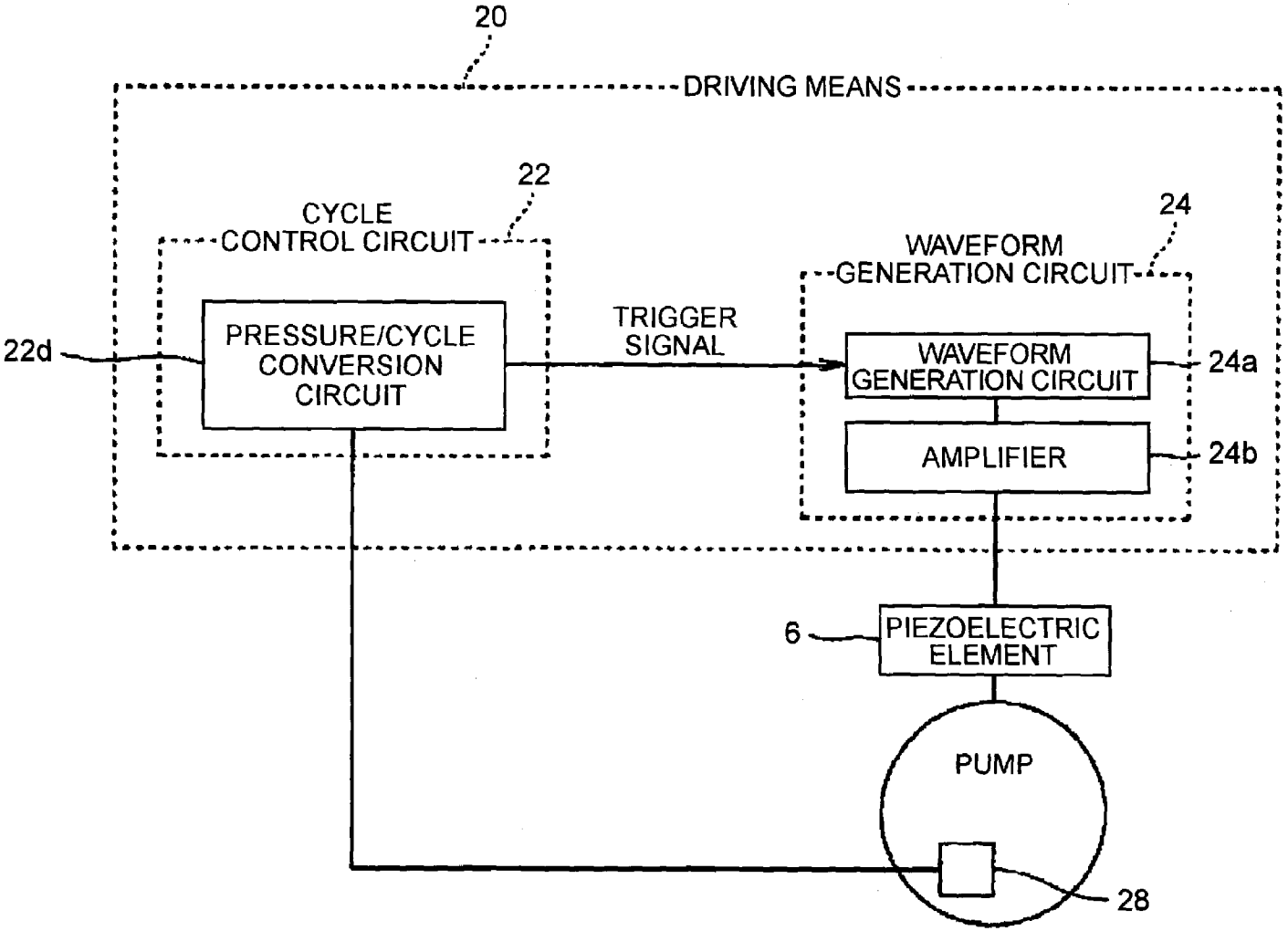
FIG. 8 is a schematic of a cycle control device according to a second exemplary embodiment of the present invention.
Figure 9:
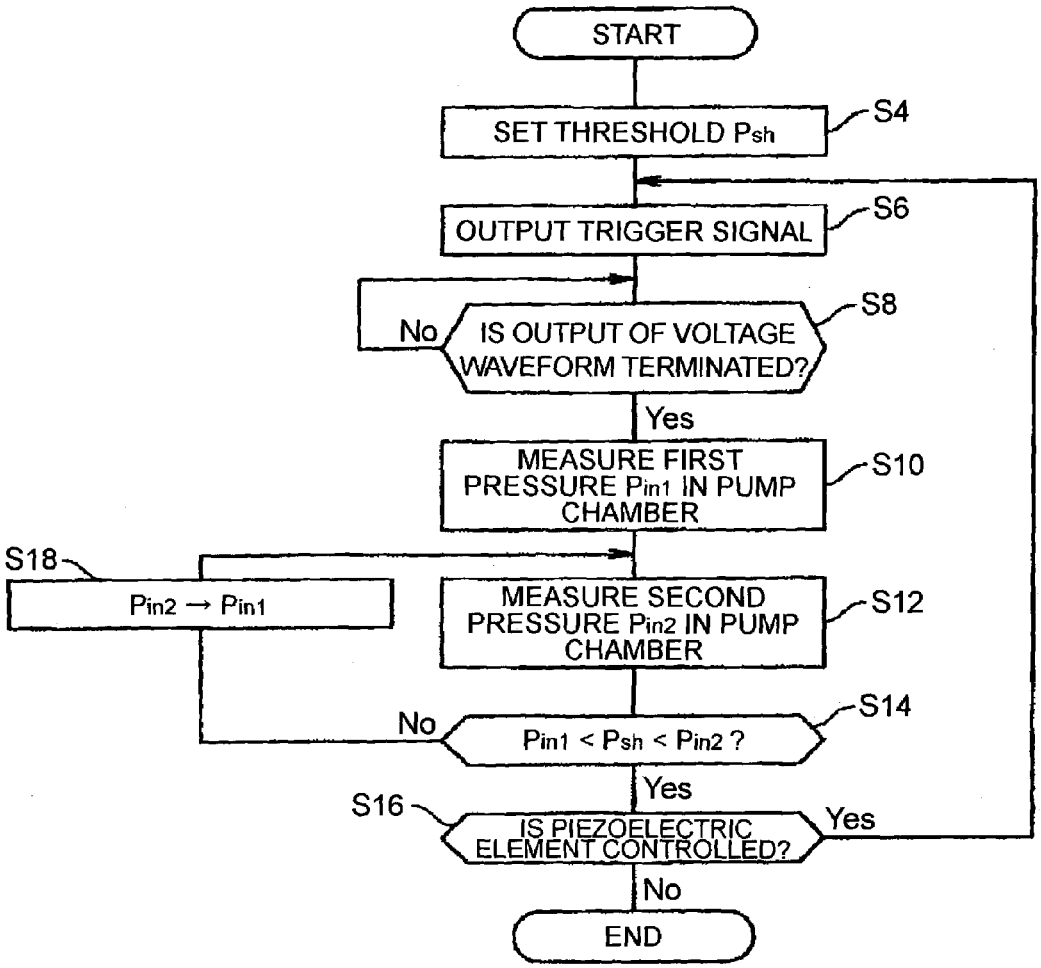
FIG. 9 is a flowchart showing the procedure of the cycle control device according to the second exemplary embodiment of the present invention.

FIGS. 8 and 9 show a second exemplary embodiment of the present invention.

The driving device 20 shown in FIG. 8 includes the cycle control circuit (a cycle control device) 22 and the voltage-waveform generation circuit 24.

The voltage-waveform generation circuit 24 has the same arrangement as that of the block diagram shown in FIG. 6. And the circuit 24 generates a voltage waveform being set before a trigger signal once each time it receives the trigger signal, which is described below.

The cycle control circuit 22 includes a pressure/cycle conversion circuit 22*d* to generate a trigger signal on the basis of a value sensed by a pressure sensor (a pump-pressure sensing device) 28 arranged in the pump.

FIG. 9 shows a flowchart for the procedure of the pressure/cycle conversion circuit 22*d*.

In step S4, first, the threshold $P_{sh}$ of the pressure is set. The threshold $P_{sh}$ uses a value larger than an output value when a suction pressure $P_{ky}$ is applied to the pressure sensor 28. This eliminates erroneous sensing due to slight pressure rise at low pressure.

The process moves to step S6 wherein a trigger signal is outputted to the voltage-waveform generation circuit 24.

The process then moves to step S8 wherein it is checked to determine as to whether one output of the voltage waveform has been finished by the voltage-waveform generation circuit 24. When it has been finished, the process moves to step S10.

In step S10, the pressure sensor 28 measures the first pressure $P_{in1}$ in the pump chamber 3.

The process next moves to step S12 where the pressure sensor 28 measures the second pressure $P_{in2}$ in the pump chamber 3.

The process moves to step S14 where it is determined as to whether the relationship among the threshold $P_{sh}$, the first pressure $P_{in1}$ in the pump chamber 3, and the second pressure $P_{in2}$ in the pump chamber 3 establishes $P_{in1}<P_{sh}<P_{in2}$. When the relation $P_{in1}<P_{sh}<P_{in2}$ has been established, the process proceeds to S16, and when the relation $P_{in1}<P_{sh}<P_{in2}$ has not been established, the process proceeds to S18.

In step S18, the value of the second pressure $P_{in2}$ in the pump chamber 3 is brought into the first pressure $P_{in1}$ in the pump chamber 3, and the process returns to step S12.

In step S16, it is determined as to whether the control of the piezoelectric element 6 is continued or stopped, where when the control of the piezoelectric element 6 is stopped, the process is stopped, and when the control of the piezoelectric element 6 is continued, the process returns to step S6.

According to the exemplary embodiment, the cycle control circuit 22 can apply the next driving voltage to the piezoelectric element 6 at the point of time when the pressure in the pump chamber 3 has exceeded the preset threshold $P_{sh}$ for the change in load pressure.

When a value larger than the output when the load pressure $P_{fu}$ is applied to the pressure sensor 28 is used, the diaphragm 5 begins to be displaced when the discharged fluid volume and the suction fluid volume are equal or the suction fluid volume is larger, thereby reducing or preventing useless consumption of the removed fluid volume and increasing the discharged fluid volume of the pump.

For a pump-pressure sensing device, a strain gauge or a displacement sensor may be used to measure the strain of the diaphragm to calculate the pressure in the pump chamber 3, except for the pressure sensor 28. It is also possible to measure the deformation of the pump frame with a strain gauge to calculate the pressure in the pump chamber 3. Furthermore, it is possible to provide a passive valve in the suction channel 1 where the deformation by the pressure in the pump chamber 3 with the valve closed is measured by the strain gauge or the displacement sensor to calculate the pressure in the pump chamber 3. It is also possible to provide the piezoelectric element 6 with a strain gauge to measure the displacement of the piezoelectric element 6 where the pressure in the pump chamber 3 may be calculated on the basis of the voltage applied to the piezoelectric element 6, or the applied charge (target displacement), the measurement (actual displacement) by the strain gauge, and the modulus of elasticity of the piezoelectric element 6. According to such a method, there is no need to arrange the measuring device in the pump chamber 3, thus promoting the reduction of the size of the pump. Any type of strain gauges may be used in which the strain is sensed from the resistance change, capacitance change, or voltage change.

It is sufficient to arrange the pressure sensor in the pump including the pump chamber and outlet flow. Preferably, it is arranged in the pump chamber because the pressure in the pump can accurately be measured.

Figure 10:
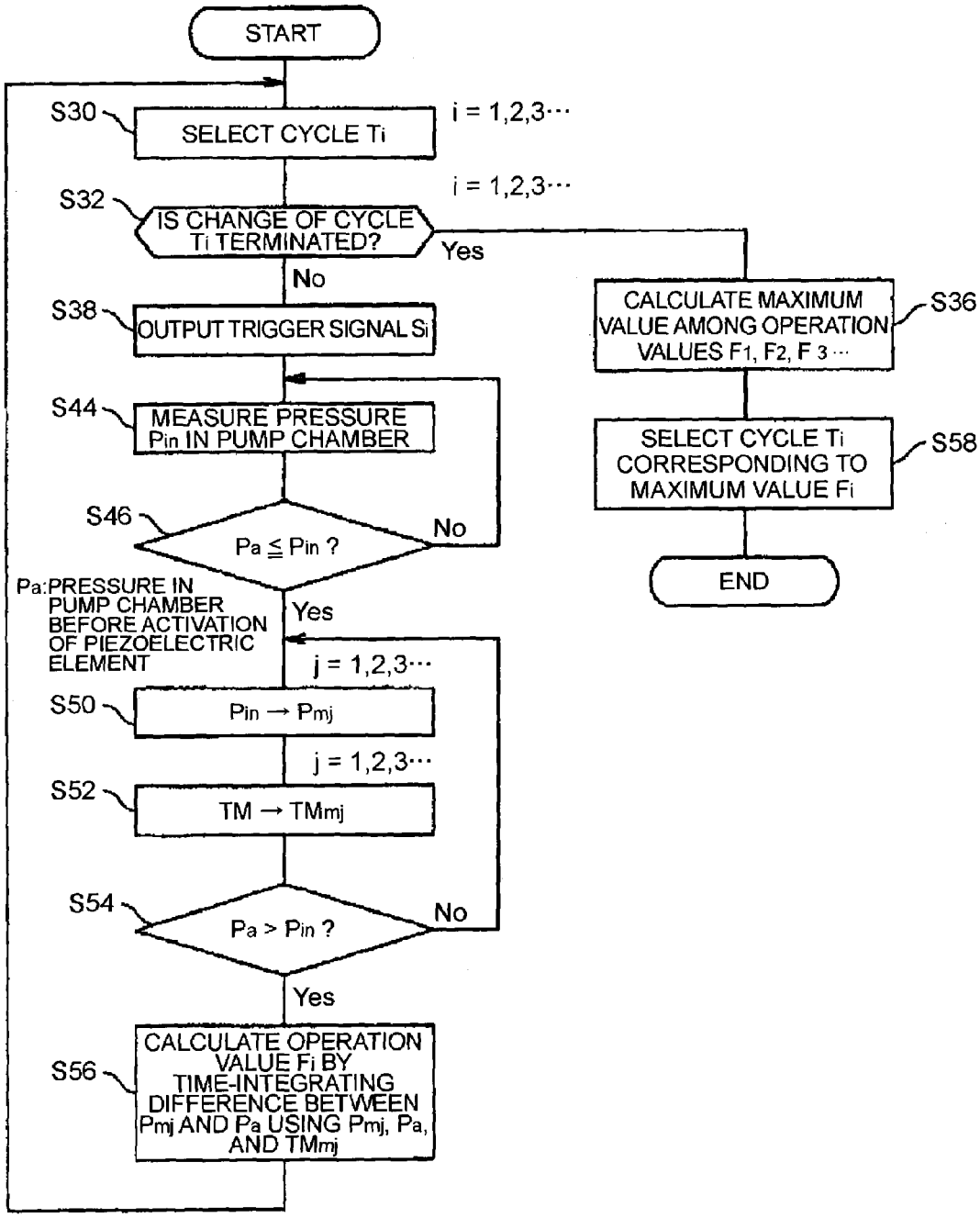
FIG. 10 is a flowchart showing the procedure of a pressure/cycle conversion circuit according to a third exemplary embodiment of the present invention.

FIG. 10 is a flowchart that shows a third exemplary embodiment of the present invention.

The flowchart shows the procedure of the pressure/cycle conversion circuit 22*d* shown in FIG. 8, having the same arrangement as that of FIG. 8. Therefore, a schematic of the driving device 20 is omitted.

In step S30, first, cycle $T_1$ is selected from a plurality of cycles $T_i$ (i=1, 2, 3 . . . ) of the diaphragm 5. In the subsequent processes, other changed cycles $T_i$ are selected.

The process then moves to step S32 where it is checked to determine whether the calculation of an operation value Fi, which is described below, has been finished for all the cycles $T_i$. When it has not been finished, the process moves to step S38, and when it has been finished, the process moves to step S36.

In step s38, a trigger signal $S_i$ is outputted.

The process then moves to step S44 where the pressure $P_{in}$ in the pump chamber 3 is measured by the pressure sensor 28.

The process moves to step S46 where it is determined as whether the relationship between the reference value (predetermined value) $P_a$ and the pressure $P_{in}$ in the pump chamber 3 establishes the relation $P_a \leqq P_{in}$, where the reference value $P_a$ is the pressure in the pump chamber 3 before the piezoelectric element 6 is activated. In this step, when the relation $P_a \leqq P_{in}$ has been established, the process moves to step S50, and when the relation $P_a \leqq P_{in}$ has not been established, the process returns to step S44.

The process then moves to step S50 wherein the pressure $P_{in}$ in the pump chamber 3 is stored in a storage pressure $P_{mj}$ (the value j is increased in each step as j=1, 2, 3 . . . ) and the process proceeds to step S52 wherein the time of measurement is stored in an elapsed time $TM_{mj}$ (j=1, 2, 3 . . . ) and the process moves to step S54.

In step S54, the pressure in the pump chamber is measured and it is checked to determine whether the relationship between the measurement $P_{in}$ and the reference value $P_a$ establishes the relation $P_a > P_{in}$. When the relation $P_a > P_{in}$ has been established, the process moves to step S56, and when the relation $P_a > P_{in}$ has not been established, the process returns to step S50.

In step S56, the difference between the storage pressure $P_{mj}$ and the reference value $P_a$ is time-integrated to calculate a calculation value Fi using the storage pressure $P_{mj}$, the reference value $P_a$, and the elapsed time $TM_{mj}$, and the process then returns to S30.

In step S36 that is a destination of procedure after the calculation of the calculation value $F_i$ for all the cycles $T_i$ of the diaphragm 5 has been finished in step S32, the maximum value of the stored calculation values $F_1$, $F_2$, $F_3$ . . . is calculated.

The process moves to step S58 wherein after the cycle $T_i$ of the diaphragm 5 that corresponds to the maximum predetermined calculation value Fi has been selected, the process is finished.

The driving device 20 then controls the activation of the piezoelectric element 6 so that the diaphragm 5 is displaced with the selected cycle $T_i$.

By the process of the pressure/cycle conversion circuit 22*d* shown in FIG. 10, a cycle can be selected in which the calculation value Fi corresponding to the left side of the expression (3) becomes maximum. On the other hand, when the activation is performed with the optimum cycle to start the displacement of the diaphragm 5 at the point of time when the discharged fluid volume and the suction fluid volume are equal or the suction fluid volume is larger, useless consumption of the removed fluid volume is reduced or eliminated in the process of compressing the capacity of the pump chamber, as described above. Accordingly, the inner pressure of the pump chamber is further increased, the discharged fluid volume of the pump is also increased, and the value corresponding to the left side of the expression (3) is also increased, as compared with the driving with a nonoptimum cycle. Consequently, controlling the motion cycle of the diaphragm, as in this exemplary embodiment, allows driving with the optimum motion cycle to reduce or prevent useless consumption of the removed fluid volume to increase the discharged fluid volume of the pump.

The time-integration of the difference between the pressure $P_{mj}$ and the reference value $P_a$ allows accurate control of the piezoelectric element 6. For example, the integral of the difference between the peak value of the pressure $P_{in}$ of the pump chamber 3 and the reference value Pa and the time when the reference value $P_a \leqq$ the pressure $P_{in}$ is satisfied can also be used.

In the pump according to the present invention, since the outlet pipe (downstream from the discharge channel 2) connected to the discharge channel 2 and the pump chamber 3 communicates with each other, the pressure in the pump chamber 3 before driving is equal to the load pressure $P_{fu}$. Thus, the load pressure $P_{fu}$ can be found by measuring the pressure in the pump chamber 3 before the driving.

The load pressure $P_{fu}$ can be obtained by other methods without setting the pressure in the pump before the driving of the piezoelectric element 6 as the reference value $P_a$, to perform the process of the third exemplary embodiment shown in FIG. 10.

According to another method, when the load pressure $P_{fu}$ is known in advance, it is simple and desirable to use the value. It is also preferable to provide a device to measure the load pressure $P_{fu}$ and to use the measurement because it can be used for various load pressures $P_{fu}$ which cannot be estimated. When operation of the pump is temporally stopped by a few waves during the operation of the pump (for example, when operated at 2 kHz, it is stopped by 10 waves after the operation of 2,000 waves and is then operated by 2,000 wave), the pressure vibration of the pump chamber 3 is stopped during the stop. Accordingly, the pressure in the pump chamber 3 is equal to the load pressure $P_{fu}$. Thus, it is preferable to use the value of the pressure sensor 28 serving as the pump-pressure sensing means at that time as the load pressure $P_{fu}$ because it can ready for various load pressures $P_{fu}$ and also there is no need to provide a new additional device to measure the load pressure.

A calculation value Fi in a certain motion cycle and a correction value to be added to the motion cycle to make it an ideal maximum calculation value Fmax are obtained in advance by experiment or the like, and they are held in the ROM serving as a displacement control device in the map form. Thus, by providing a device to calculate the calculation value Fi, referring to the map, and correcting the motion cycle of the diaphragm 5, the displacement rate can be controlled at higher speed while offering similar advantages.

Figure 11:
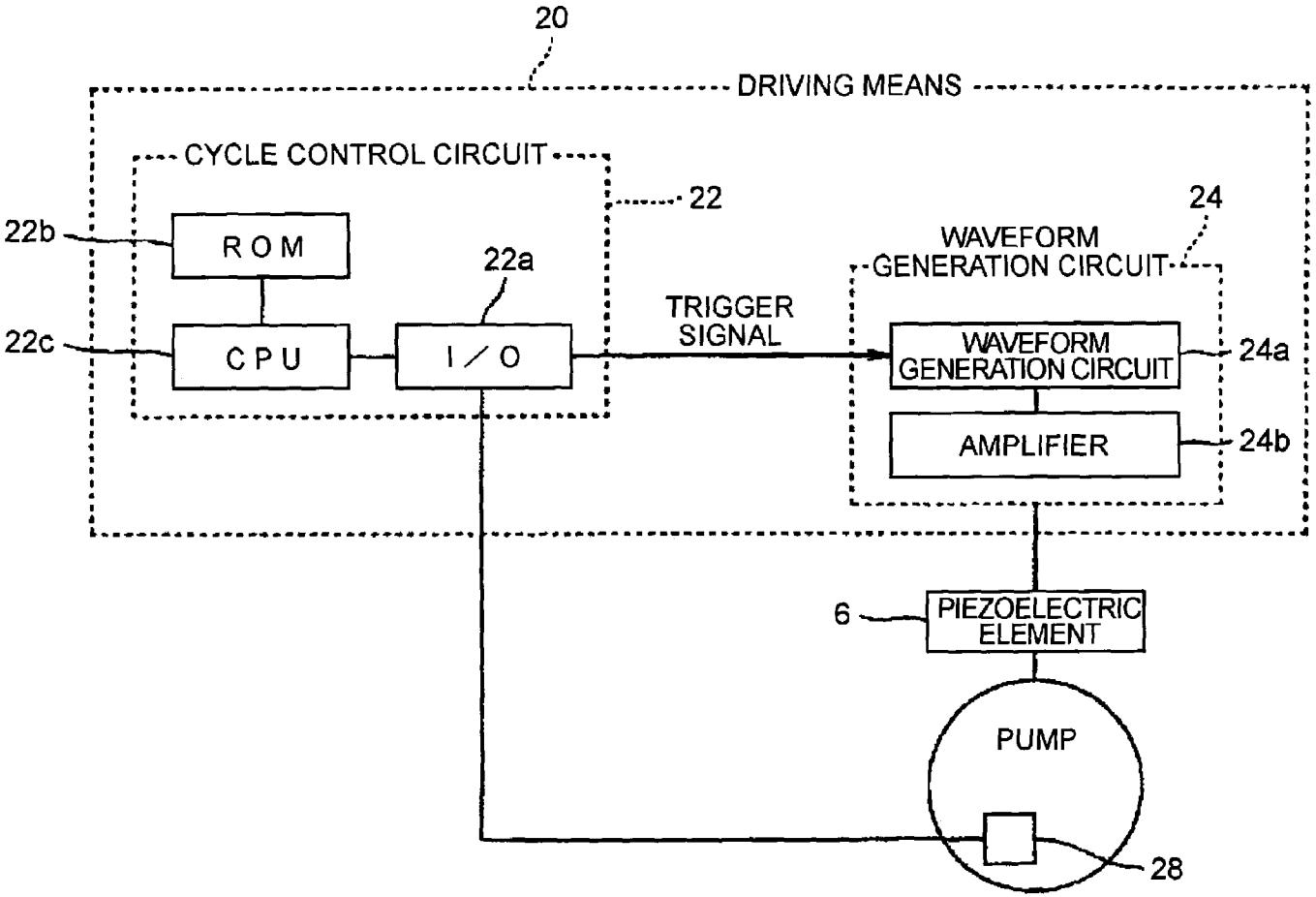
FIG. 11 is a schematic of a cycle control device according to a fourth exemplary embodiment of the present invention.
Figure 12:
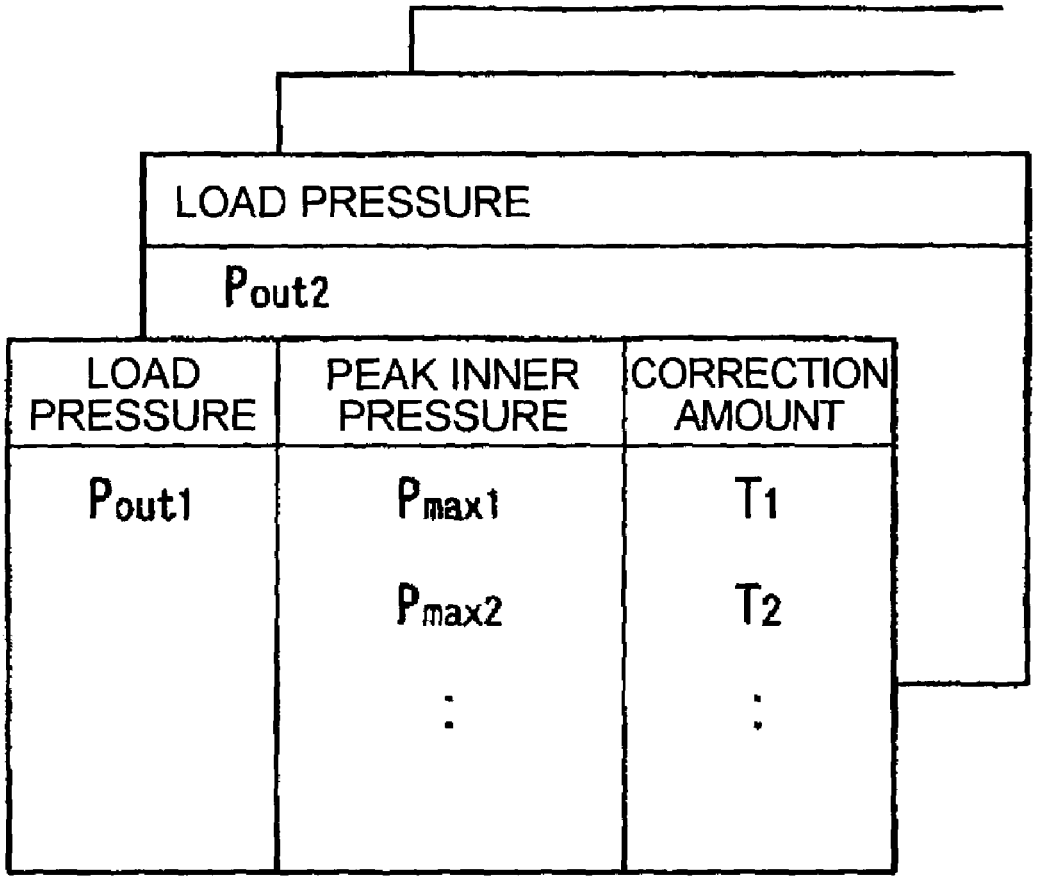
FIG. 12 is a schematic showing maps stored with the cycle control device according to the fourth exemplary embodiment.

FIGS. 11 and 12 show a fourth exemplary embodiment of the present invention.

As shown in FIG. 11, the cycle control circuit 22 of this exemplary embodiment includes an I/O port 22*a*, an ROM 22*b*, and a CPU 22*c*, where the pressure information of the pump chamber 3 is inputted to the I/O port 22*a* from the pressure sensor (a pump-pressure sensing device) 28 arranged in the pump. In the ROM 22*b*, the peak inner pressure of the pressure sensor 28 in a certain reference motion cycle $T_0$ and a correction value to make it the optimum cycle, which are obtained by experiment in advance, are recorded as maps for each load pressure, as shown in FIG. 12.

When the waveform generation circuit 24 of this exemplary embodiment outputs a first driving voltage, the cycle control circuit 22 generates a trigger signal with the reference motion cycle $T_0$, and the waveform generation circuit 24 starts a second output of driving voltage, measurement by the pressure sensor 28 is started, and a peak value is calculated from the measured value. Thereafter, a corresponding correction amount is found with reference to the ROM 22*b*, and a trigger signal is outputted with cycles in which the correction amount is added to the reference motion cycle from the next time. To obtain the load pressure, all of the methods described in the third exemplary embodiment may be employed similarly.

Also in this exemplary embodiment, driving voltage waveform is transmitted to the piezoelectric element 6 with a selected optimum cycle, so that the diaphragm 5 is displaced in a state in which the discharged fluid volume and the suction fluid volume are equal or the suction fluid volume is larger. Accordingly, useless consumption of the removed fluid volume can be prevented to increase the discharged fluid volume of the pump.

Figure 13:
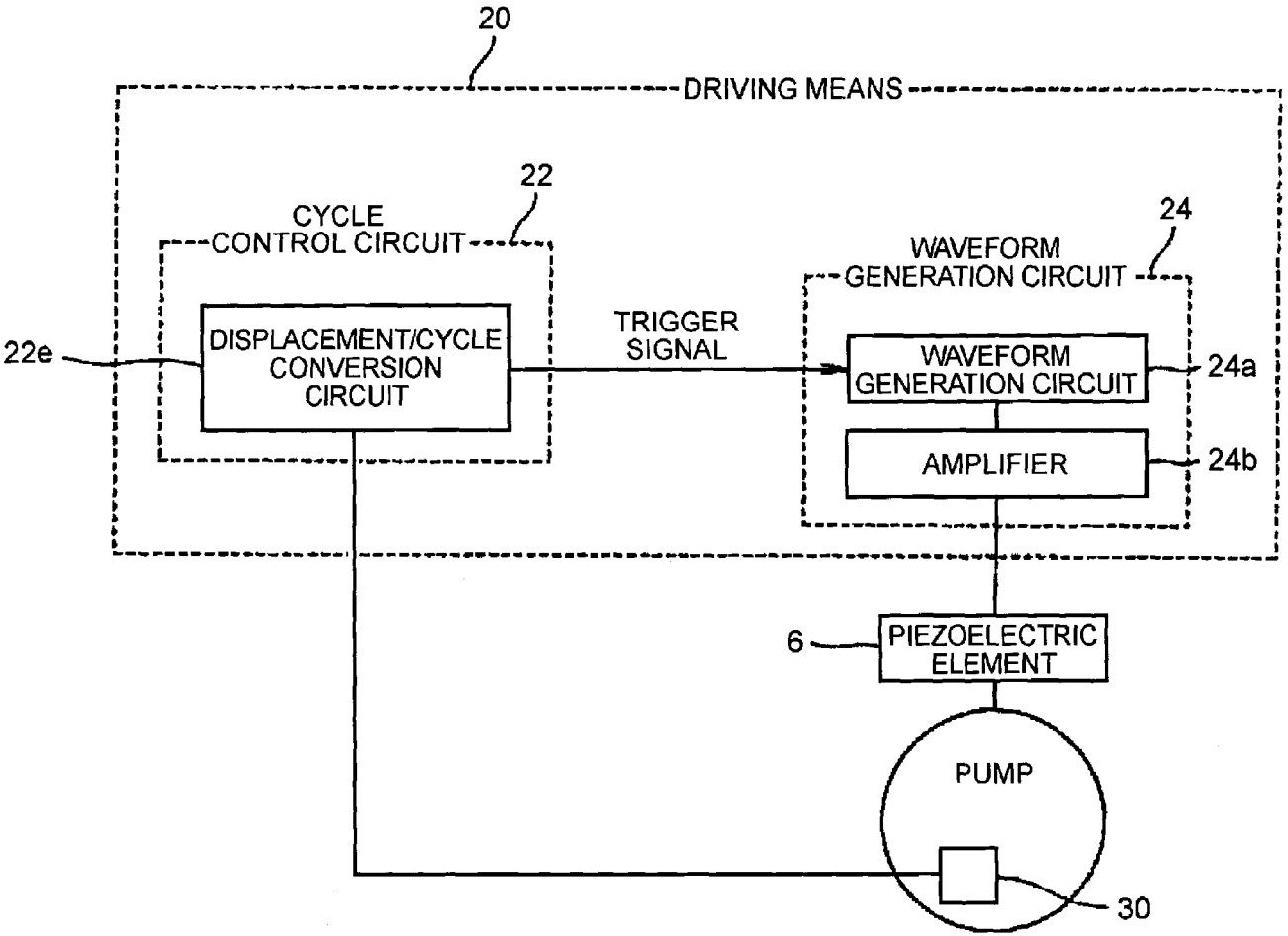
FIG. 13 is a schematic of a cycle control device according to a fifth exemplary embodiment of the present invention.
Figure 14:
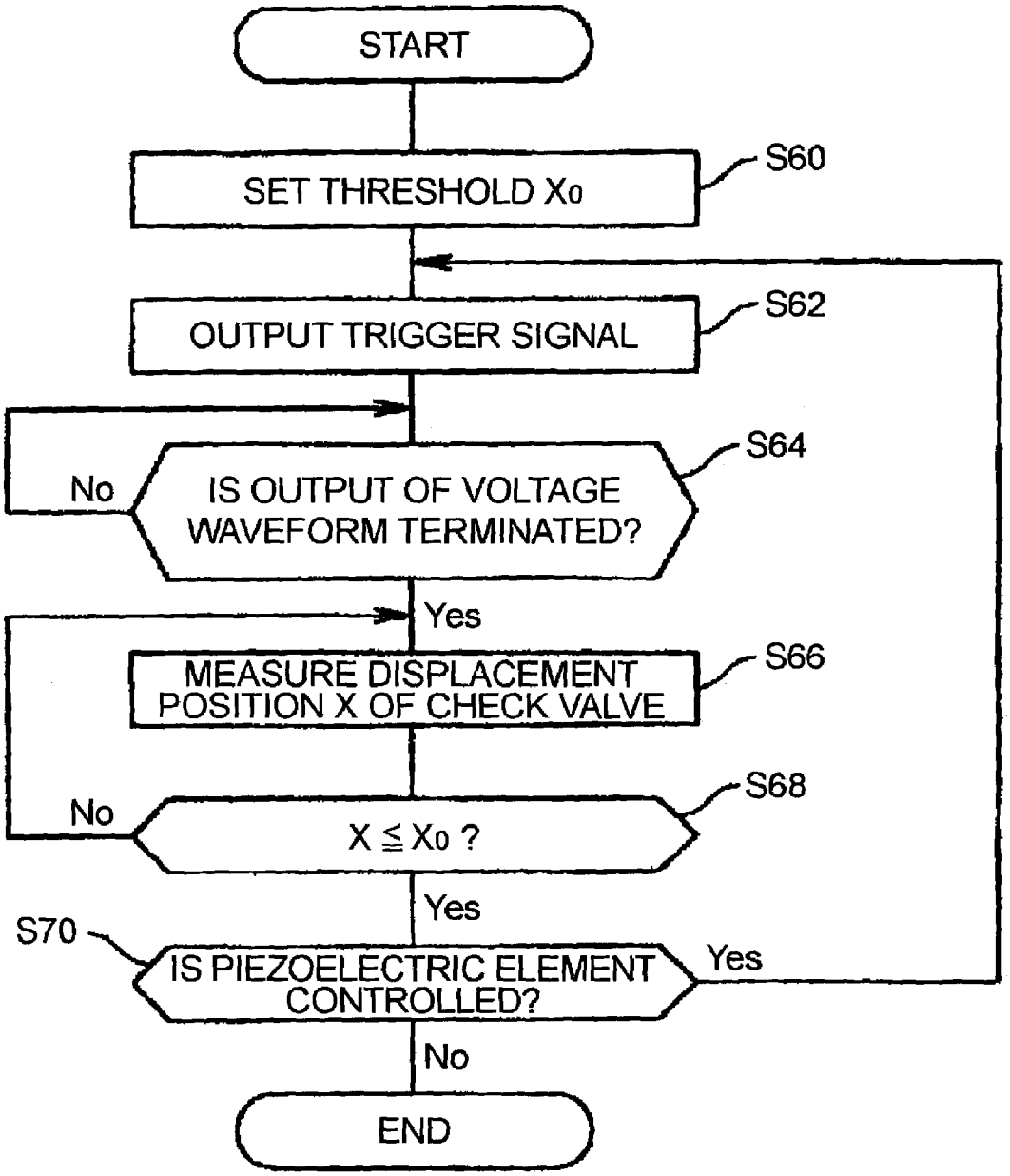
FIG. 14 is a flowchart showing the procedure of a displacement/cycle conversion circuit according to the fifth exemplary embodiment of the present invention.

FIGS. 13 and 14 show a fifth exemplary embodiment according to the present invention.

The driving device 20 of this exemplary embodiment shown in FIG. 13 includes the cycle control circuit (a cycle control device) 22 and the voltage-waveform generation circuit 24. The cycle control circuit 22 includes a displacement/cycle conversion circuit 22*e* to generate a trigger signal on the basis of a value sensed by a displacement sensor 30 that senses the displacement state of the switching of the check valve 4 which is provided in the suction channel 1 in the pump and is opened or closed by the pressure difference.

FIG. 14 shows a flowchart for the procedure of the displacement/cycle conversion circuit 22*e*.

In step S60, first, a threshold $X_0$ is set which corresponds to the displacement amount when the check valve 4 for closing the suction channel 1 is substantially closed.

The process moves to step S62 wherein a trigger signal is outputted.

The process then moves to step S64 where it is checked to determine whether one output of the voltage waveform has been finished, and when it has been finished, the process proceeds to step S66.

In step S66, the displacement X of the check valve 4 is measured by the displacement sensor 30.

Subsequently, the process moves to step S68 where it is checked to determine whether the relationship between the displacement (threshold) $X_0$ of the check valve 4 to close the suction channel 1 and the measured displacement X establishes $X \leqq X_0$. When the relation $X \leqq X_0$ has been established, the process proceeds to step S70. When the relation $X \leqq X_0$ has not been established, the process returns to step S66.

In step S70, a determination is made as to whether the control of the piezoelectric element 6 is continued or stopped, such that when the control of the piezoelectric element 6 is stopped, the process is stopped, and when the control of the piezoelectric element 6 is continued, the process returns to step S62.

The exemplary embodiment makes use of the fact that after the application of the driving voltage of one cycle has been completed, the increased amount of the suction fluid volume gradually becomes larger than the increased amount of the discharged fluid volume and when the discharged fluid volume and the suction fluid volume become substantially equal, the check valve is closed. Accordingly, the displacement/cycle conversion circuit 22*e* processes to apply the next driving voltage to the piezoelectric element 6 at the point of time when the check valve 4 closes the suction channel 1, so that the diaphragm 5 begins to be displaced at the point in time when the discharged fluid volume and the suction fluid volume become substantially equal. Consequently, useless consumption of the removed fluid volume can be reduced or prevented to increase the discharged fluid volume of the pump.

In the exemplary embodiment, since the piezoelectric element 6 is activated after the check valve 4 has been closed, the loss of the discharged fluid volume due to the backflow thereof by the diaphragm 5 through the suction channel 1 can be reduced or prevented.

Figure 15:
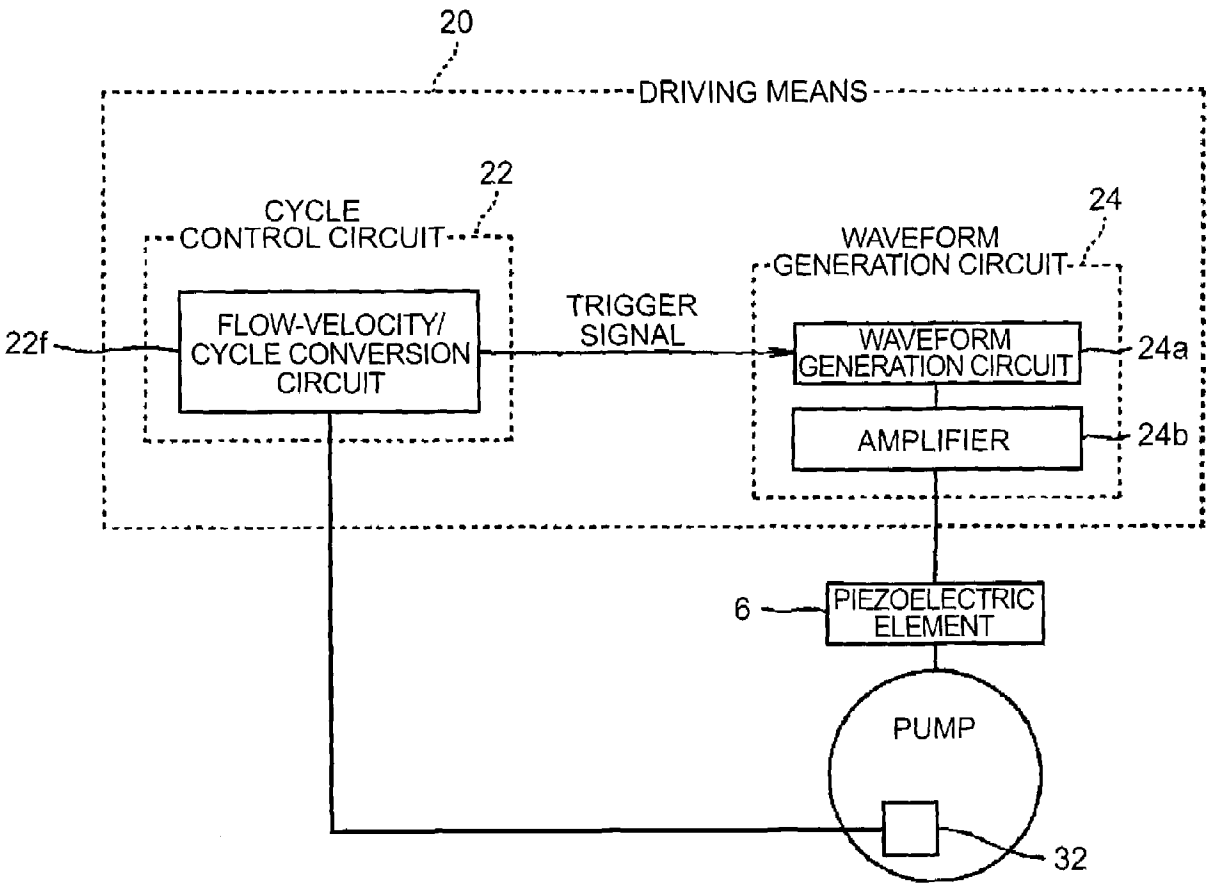
FIG. 15 is a schematic of a cycle control device according to a sixth exemplary embodiment of the present invention.
Figure 16:
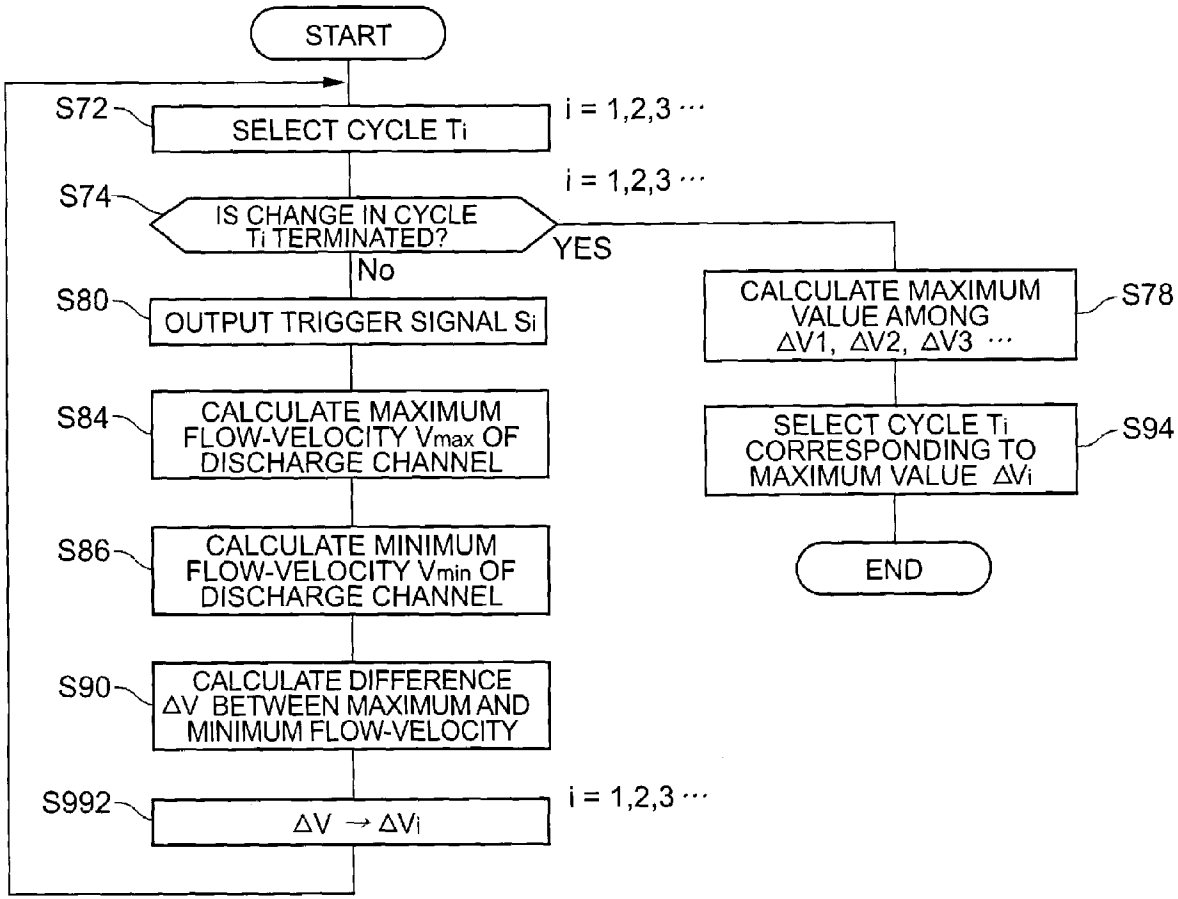
FIG. 16 is a flowchart showing the procedure of a flow-velocity/cycle conversion circuit according to the sixth exemplary embodiment of the present invention.

FIGS. 15 and 16 show a sixth exemplary embodiment according to the present invention.

The driving device 20 shown in FIG. 15 includes the cycle control circuit (a cycle control device) 22 and the voltage-waveform generation circuit 24. The cycle control circuit 22 includes a flow-velocity/cycle conversion circuit 22*f* to generate a trigger signal on the basis of a value sensed by a flow velocity sensor (a flow velocity measuring device) 30 arranged in the discharge channel 2 in the pump.

FIG. 16 shows a flowchart for the procedure of the flow-velocity/cycle conversion circuit 22*f*.

In step S72, first, cycle $T_1$ is selected among the plurality of cycles $T_i$ (i=1, 2, 3 . . . ) of the diaphragm 5. In the subsequent processes, other changed cycles $T_i$ are selected.

The process then moves to step S74 where it is checked to determine whether the calculation of a flow velocity difference $\Delta V_i$, which is described below, has been finished for all the cycles $T_i$. When it has not been finished, the process moves to step S80, and when it has been finished, the process moves to step S78.

In step S80, a trigger signal $S_i$ is outputted.

The process then moves to step S84 where the maximum flow velocity Vmax in the discharge channel 2 is calculated. The process then moves to step S86 wherein the minimum flow velocity Vmin in the discharge channel 2 is calculated.

Subsequently, the process moves to step S90 where the difference $\Delta V$ between the maximum flow velocity Vmax and the minimum flow velocity Vmin is calculated.

Subsequently, the process moves to step S92 where the flow velocity difference $\Delta V$ is stored in storage flow velocity $\Delta V_i$ (i=1, 2, 3 . . . ), and the process returns to step S72.

When the calculation of the flow velocity difference $\Delta V_i$ for all the cycles $T_i$ has been finished, the process moves to step S78 wherein the maximum value of the stored velocity differential $\Delta V1$, $\Delta V2$, $\Delta V3$ . . . is calculated.

The process then moves to step S94 where the cycle $T_i$ that corresponds to the maximum predetermined velocity differential $\Delta V_i$ has been selected, and the process is finished.

The driving device 20 then controls the activation of the piezoelectric element 6 so that the diaphragm 5 is displaced with the selected cycle $T_i$.

The exemplary embodiment makes use of the fact that the difference in fluid volume velocity during the integration, and the time integral of the pressure difference between the pressure in the pump chamber 3 and the load pressure corresponds one to one, as shown in the expression (3), and that with the more desirable motion cycle the diagram is actuated, the larger the time integral. Consequently, by the process of the flow-velocity/cycle conversion circuit 22*f* shown in FIG. 16, the diaphragm can be actuated with the optimum motion cycle. Accordingly, useless consumption of the removed fluid volume can be reduced or prevented to increase the discharged fluid volume of the pump. Thus, a pump with a high driving efficiency can be provided.

Figure 17:
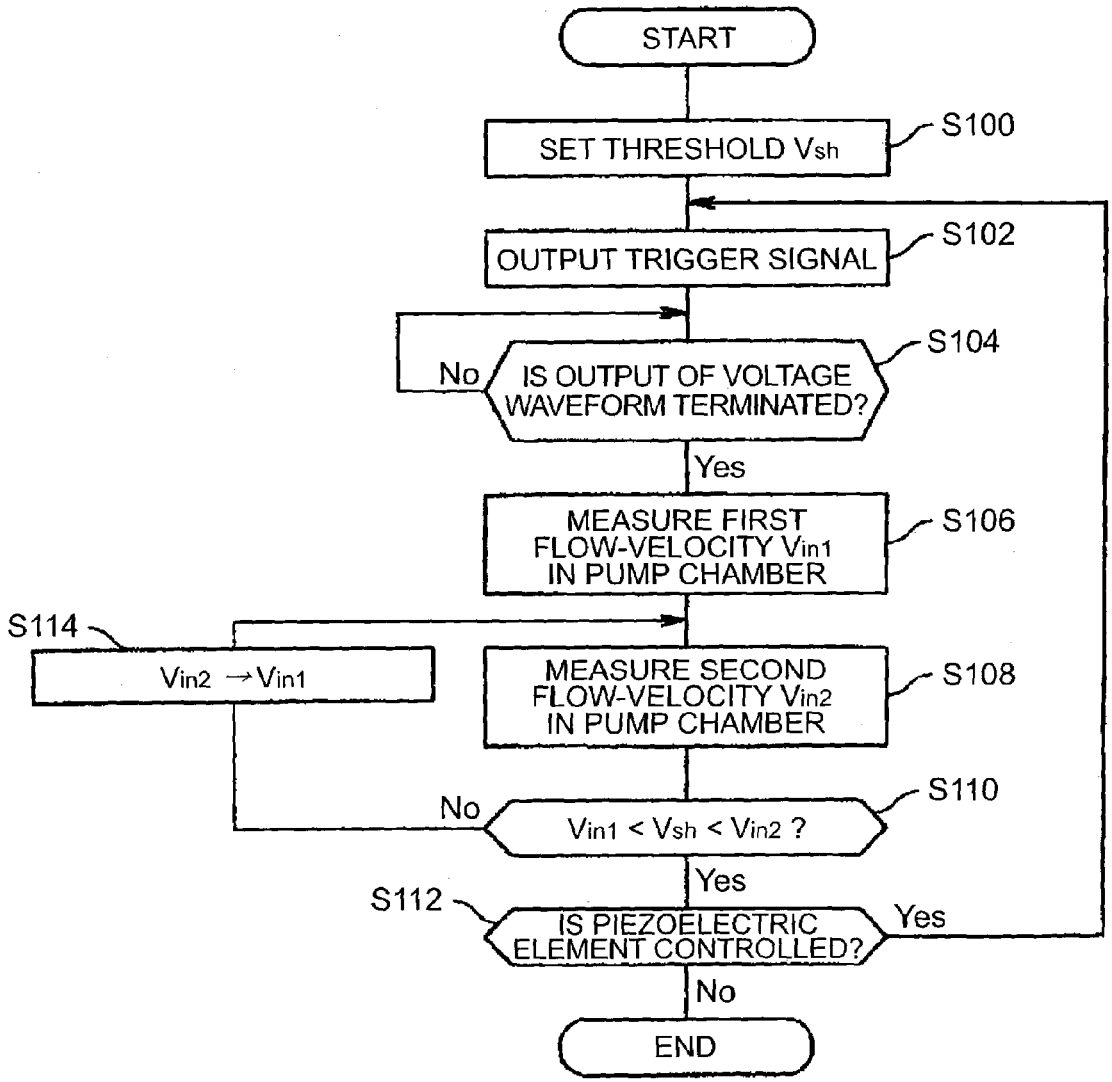
FIG. 17 is a flowchart showing the procedure of flow-velocity/cycle conversion circuit according to a seventh exemplary embodiment of the present invention.

FIG. 17 shows a flowchart for the procedure of the flow-velocity/cycle conversion circuit 22*f* of a seventh exemplary embodiment.

In step S100, first, a threshold Vsh of the flow velocity in the discharge channel 2 is set.

The process then moves to step S102 where a trigger signal is outputted.

Subsequently, the process moves to step S104 where it is checked to determine whether one output of the voltage waveform has been finished, such that when it has been finished, the process proceeds to step S106.

In step S106, the first flow velocity $V_{in1}$ of the discharge channel 2 is measured by a flow velosity sensor 32.

The process moves to step S108 wherein the second flow velocity Vin2 of the discharge channel 2 is measured by the flow velocity sensor 32.

The process then moves to step S110 wherein it is checked to determine whether the relationship among the threshold $V_{sh}$, the first flow velocity $V_{in1}$ of the discharge channel 2, and the second flow velocity $V_{in2}$ of the discharge channel 2 has established the relation $V_{in1}<V_{sh}<V_{in2}$. When the relation $V_{in1}<V_{sh}<V_{in2}$ has been established, the process moves to step S112, and when the relation $V_{in1}<V_{sh}<V_{in2}$ has not been satisfied, the process moves to step S14.

In step S14, the value of the second flow velocity $V_{in2}$ of the discharge channel 2 is brought into the first flow velocity $V_{in1}$ of the discharge channel 2, and the process returns to step S108.

In step S12, a determination is made as to whether the control of the piezoelectric element 6 is continued or stopped, wherein when the control of the piezoelectric element 6 is stopped, the process is stopped, and when the control of the piezoelectric element 6 is continued, the process returns to step S102.

The exemplary embodiment makes use of the fact that the flow velocity of the fluid in the discharge channel 2 decreases during the period of time when the inner pressure of the pump is lower than the load pressure after the completion of one application of the driving voltage, as shown in FIG. 2, and that when the discharged fluid volume and the suction fluid volume become equal or the suction fluid volume becomes larger, the inner pressure of the pump becomes higher than the load pressure to increase the flow velocity in the discharge channel 2. Accordingly, the next driving voltage for the piezoelectric element 6 is applied at the point of time when the flow velocity of the discharge channel 2 is increased, as in the flow velocity/cycle conversion circuit 22*f* of this exemplary embodiment, the diaphragm 5 begins to be displaced at the point of time when the discharged fluid volume and the suction fluid volume become equal or the suction fluid volume becomes larger. Consequently, useless consumption of the removed fluid volume is reduced or prevented to increase the discharged fluid volume of the pump.

There is also a method in which the peak flow velocity when the diaphragm is moved with a certain reference cycle $T_0$ and the correction amount to be added to the reference cycle when the peak flow velocity is set to the maximum peak flow velocity are obtained in advance by experiment for each displacement rate of the diaphragm and for each load pressure, which are recorded in maps in the ROM or the like that constitutes the cycle control circuit 22. In that case, measurement by the flow velocity sensor 32 is started when the diaphragm is moved with the reference cycle $T_0$ under the conditions of the known diaphragm displacement rate and load pressure; a peak value is calculated from the measured value; the corresponding correction amount is found with reference to the maps in the ROM; and a trigger signal is outputted from the next time with a cycle in which the correction amount is added to the reference cycle $T_0$. With such an arrangement, advantages similar to those of the above-described embodiments can be offered.

For the flow velocity sensor 32, an ultrasonic system, a measuring system of converting the flow velocity to the pressure, and a hot-wire flow sensor may be used. It is sufficient to arrange the flow velocity sensor 32 downstream including the discharge channel.

Figure 18:
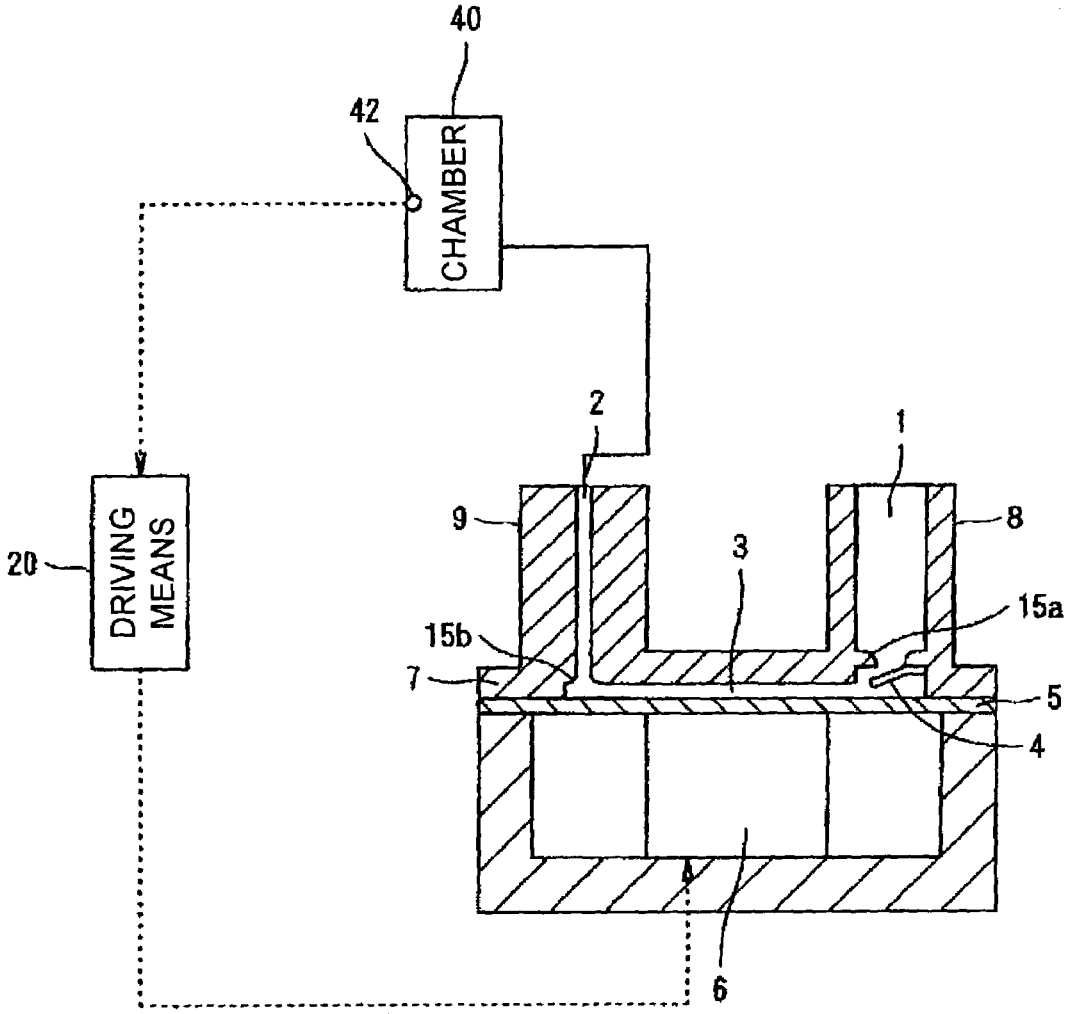
FIG. 18 is a schematic of a pump according to an eighth exemplary embodiment of the present invention.

FIG. 18 shows an eighth exemplary embodiment according to the present invention.

In this exemplary embodiment, a chamber 40 capable of storing fluid is connected to the discharge channel 2 of the pump. The chamber 40 and a fluid level sensor 42 provided therein constitute moving-fluid-volume measuring means, where sense information on the fluid level is inputted from the fluid level sensor 42 to the driving device 20.

The chamber 40 is empty initially. When fluid is discharged from the discharge channel 2 of the pump, the driving device 20 measures the discharge time and the fluid level to calculate the discharge volume of the diaphragm 5 per unit time. The motion cycle of the diaphragm 5 is set as appropriate so that the discharge volume becomes maximum. Consequently, the diaphragm can be moved with the optimum cycle such that the discharged fluid volume per unit time becomes maximum. Thus, a pump with a high driving efficiency can be provided.

Also, s pulse absorbing buffer, not shown, is provided at the suction channel 1 or the discharge channel 2 in place of the moving-fluid-volume measuring device which consisted of the chamber 40 and the fluid level sensor 42 to measure and output the displacement of the film of the buffer may be provided, in which the motion cycle of the diaphragm 5 may be set so that the displacement of the buffer film becomes maximum. This is because the larger the discharged fluid volume (=suction fluid volume) for one cycle of pumping, with greater amplitude the buffer film oscillates, so that the discharged fluid volume (=suction fluid volume) for one cycle of pumping becomes maximum when the displacement of the buffer film is maximum.

As described above, the pump according to the present invention may have the valve only at the suction channel and the fluid resistive element such as a valve only at the suction channel. Accordingly, the loss of pressure in the fluid resistive element can be reduced and the reliability of the pump can be increased.

A displacement enlarging mechanism is not disposed between the piston or the diaphragm and the actuator to activate it, and the valve does not use viscous resistance, thus being ready for high frequency driving. Accordingly, a compact lightweight pump with high output that makes the most of the performance of the actuator can be realized.

Providing the cycle control device reduces or prevents useless consumption of the removed fluid volume, thus increasing the corresponding discharged fluid volume and discharge pressure of the pump. Accordingly, a pump with a high driving efficiency can be provided.

What is claimed is:

1. A pump for use with a working fluid, comprising:

a moving wall;

an actuator to change a position of the moving wall;

a driving device to control activation of the actuator;

a pump chamber having a capacity that can be varied by the displacement of the moving wall;

a suction channel for admission of the working fluid into the pump chamber; and a discharge channel for delivery of the working fluid from the pump chamber, the discharge channel being opened to the pump chamber during operation of the pump, a combined inertance of the suction channel being lower than a combined inertance of the discharge channel;

the suction channel including a fluid resistive element having a fluid resistance during the inflow of the working fluid into the pump chamber that becomes lower than a fluid resistance during the outflow; and the driving device including a cycle control device which controls a start of a next cycle of the motion of the moving wall after completion of a previous cycle of the motion of the moving wall.

2. The pump according to claim 1, the cycle control device changing the cycle of the motion of the moving wall depending on the load pressure downstream from the discharge channel.

3. The pump according to claim 1, the cycle control device changing the cycle of the motion of the moving wall depending on the displacement time, the displacement amount, or the displacement rate in the pump-chamber-capacity compression process of the moving wall.

4. The pump according to claim 1, the cycle control device controlling the start of the next cycle of the motion of the moving wall in accordance with the sense information of pump-pressure sensing device to sense the pressure in the pump.

5. The pump according to claim 4, the cycle control device controlling the start of the next cycle of the motion of the moving wall when the pump-pressure sensing device senses an increase in pressure after the completion of the previous cycle of the motion of the moving wall.

6. The pump according to claim 4, the cycle control device controlling the start of the next cycle of the motion of the moving wall in accordance with an calculation value using a predetermined value and the sensed value of the pump-pressure sensing device.

7. The pump according to claim 6, the predetermined value being the pressure in the pump chamber which is measured by the pump-pressure sensing device before the activation of the actuator.

8. The pump according to claim 6, the predetermined value being the pressure in the pump chamber which is measured by the pump-pressure sensing device after a lapse of a predetermined time from the previous application of the drive waveform.

9. The pump according to claim 6, the predetermined value being a value inputted in advance and substantially corresponding to the load pressure downstream from the discharge channel.

10. The pump according to claim 6, further comprising a load-pressure sensing device to sense the load pressure downstream from the discharge channel, the predetermined value being a value measured by the load-pressure sensing device.

11. The pump according to claim 6, the calculation value being a value obtained by time-integrating the difference between the sensed value and the predetermined value for the period during which the value sensed by the pump-pressure sensing means is larger than the predetermined value.

12. The pump according to claim 1, further comprising a passive valve in the suction channel, the cycle control device sensing the displacement of the valve and changes the cycle of the motion of the moving wall on the basis of the sensed value.

13. The pump according to claim 1, the cycle control device changing the cycle of the motion of the moving wall in accordance with the sense information of a flow velocity measuring device to sense the flow velocity of the downstream including the discharge channel.

14. The pump according to claim 13, the cycle control device controlling the start of the next cycle of the motion of the moving wall after the flow velocity measuring device has sensed an increase in flow velocity from the completion of the previous cycle of the motion of the moving wall.

15. The pump according to claim 13, the cycle control device changing the cycle of the motion of the moving wall depending on the difference between the maximum value and the minimum value of the flow velocity measured by the flow velocity measuring device.

16. The pump according to claim 1, the cycle control device changing the cycle of the motion of the moving wall in accordance with the sense information of a moving-fluid-volume measuring device to sense the suction volume of the suction channel or the discharged volume of the discharge channel.

17. The pump according to claim 1, the actuator being a piezoelectric element.

18. The pump according to claim 1, the actuator being a giant magnetostrictive element.

* * * * *